US011014135B2

(12) United States Patent
Brewer, Jr. et al.

(10) Patent No.: US 11,014,135 B2
(45) Date of Patent: May 25, 2021

(54) METHOD FOR FORMING A METAL BEAM OR STRINGER

(71) Applicant: NWI NASHVILLE, LLC, Asheville, NC (US)

(72) Inventors: Harold M. Brewer, Jr., Goodlettsville, TN (US); Steven McDonough, Burns, TN (US); Charles Phy, McEwen, TN (US); David Rose, Waverly, TN (US); Brian Travis, Burns, TN (US); Keith Willhite, Hurricane Mills, TN (US)

(73) Assignee: NWI NASHVILLE, LLC, Asheville, NC (US)

( * ) Notice: Subject to any disclaimer, the term of this patent is extended or adjusted under 35 U.S.C. 154(b) by 409 days.

(21) Appl. No.: 16/055,915

(22) Filed: Aug. 6, 2018

(65) Prior Publication Data

US 2018/0345346 A1 Dec. 6, 2018

Related U.S. Application Data

(63) Continuation of application No. 14/851,498, filed on Sep. 11, 2015, now Pat. No. 10,052,670.

(51) Int. Cl.
*B21D 7/14* (2006.01)
*B21D 5/04* (2006.01)
(Continued)

(52) U.S. Cl.
CPC ..... *B21D 5/04* (2013.01); *B21D 7/00* (2013.01); *B21D 7/03* (2013.01); *B21D 7/12* (2013.01); *B21D 7/14* (2013.01); *B21D 53/92* (2013.01)

(58) Field of Classification Search
CPC ... B21D 7/14; B21D 7/12; B21D 7/03; B21D 5/006; B21D 53/92
See application file for complete search history.

(56) References Cited

U.S. PATENT DOCUMENTS 1,996,838 A 4/1935 Snell
2,947,344 A 8/1960 Springer
(Continued)

FOREIGN PATENT DOCUMENTS

CN 2688409 3/2005
FR 2856615 12/2004

OTHER PUBLICATIONS

Shigley, "Mechanical Engineering Design—Fundamentals of Mechanical Design—Stress Analysis", 1963, pp. 48-50, 58, 64-66.
(Continued)

*Primary Examiner* — Adam J Eiseman
*Assistant Examiner* — Bobby Yeonjin Kim
(74) *Attorney, Agent, or Firm* — Clark Hill PLC; James R. Foley

(57) ABSTRACT

A method for forming a metal beam may comprise: clamping first and second portions of the metal beam in a substantially fixed and in a position whereat the metal beam is rotatable about three axes; applying a net bending force to the clamped second portion of the metal beam at a predetermined angle; sensing twisting of the second portion of the metal beam resulting from the net bending force; and modulating the angle at which the net force is applied to reduce the twisting of the metal beam. As a result, the net bending force is moved toward the shear center and toward being along the principal axis of the metal beam.

30 Claims, 9 Drawing Sheets

(51) Int. Cl.

| | |
|---|---|
| ***B21D 7/00*** | (2006.01) |
| ***B21D 7/03*** | (2006.01) |
| ***B21D 7/12*** | (2006.01) |
| *B21D 53/92* | (2006.01) |

(56) References Cited

U.S. PATENT DOCUMENTS

| | | | | |
|---|---|---|---|---|
| 3,667,269 | A | | 6/1972 | Bergner |
| 3,731,513 | A | | 5/1973 | Kindermann et al. |
| 3,854,215 | A | | 12/1974 | Foster |
| 3,906,765 | A | * | 9/1975 | Foster ..... G05B 19/4163 72/8.9 |
| 3,952,572 | A | | 4/1976 | Mergler et al. |
| 3,955,389 | A | * | 5/1976 | Foster ..... B21D 5/08 72/7.4 |
| 4,005,782 | A | | 2/1977 | Crockett |
| 4,403,495 | A | | 9/1983 | Talbot |
| 4,450,707 | A | | 5/1984 | Ricard et al. |
| 4,569,703 | A | | 2/1986 | Baba et al. |
| 4,878,369 | A | * | 11/1989 | Apps ..... B21D 11/00 72/18.7 |
| 4,972,696 | A | | 11/1990 | Apps et al. |
| 6,253,591 | B1 | | 7/2001 | Sayama et al. |
| 6,386,481 | B1 | | 5/2002 | Kallinen |
| 6,446,484 | B1 | | 9/2002 | Anderson et al. |
| 6,640,595 | B2 | | 11/2003 | Sundgren et al. |
| 6,938,448 | B2 | | 9/2005 | Kennerknecht et al. |
| 7,240,528 | B2 | | 7/2007 | Weise et al. |
| 8,333,096 | B2 | | 12/2012 | Heinz et al. |
| 8,672,269 | B2 | | 3/2014 | Motohashi et al. |
| 8,752,294 | B2 | | 6/2014 | Minshull |
| 9,403,239 | B2 | | 8/2016 | Gregg et al. |
| 9,789,526 | B2 | | 10/2017 | Kozaki et al. |
| 9,802,234 | B2 | | 10/2017 | Kozaki et al. |
| 10,052,670 | B2 | | 8/2018 | Brewer, Jr. et al. |

OTHER PUBLICATIONS

Bruhn, "Analysis and Design of Flight Vehicle Structures", 1973, pp. A3.10-A3.11.

Bauld, "Mechanics of Materials", 1982, pp. 543-545.

Modern Machine Shop, "Stringer Solution", http://www.mmsonline.com/articles/stringer-solution, Sep. 15, 2002, 2 pages.

International Searching Authority/US, "International Search Report and Written Opinion" International Application No. PCT/US2016/051004, dated Dec. 23, 2016, 6 pages.

* cited by examiner

| WING SURFACE | STRINGER | TYPE | LENGTH (in.) | MAX. DEFLECTION (in.) | SHAPE |
|---|---|---|---|---|---|
| UPPER | 1 | Zee | 137 | 0.626 | S |
| UPPER | 2 | Zee | 187.8 | 0.781 | S |
| UPPER | 3 | Zee | 237.1 | 0.976 | S |
| UPPER | 4 | Zee | 288.2 | 1.244 | S |
| UPPER | 5 | Zee | 320.6 | 1.537 | S |
| UPPER | 6 | Zee | 372.5 | 2.133 | U |
| UPPER | 7 | Zee | 415.1 | 2.669 | U |
| UPPER | 8 | Zee | 449 | 2.99 | U |
| UPPER | 9 | Vent | 541.9 | 3.609 | U |
| UPPER | 10 | Zee | 547.4 | 3.519 | U |
| UPPER | 11 | I/B Zee | 281.1 | 1.583 | U |
| UPPER | 11 | O/B Zee | 258.5 | 0.242 | S |
| UPPER | 12 | Zee | 547.2 | 3.369 | U |
| UPPER | 13 | Zee | 547.4 | 3.303 | U |
| UPPER | 14 | Zee | 486 | 3.006 | U |
| UPPER | 15 | Zee | 430.5 | 2.878 | U |
| UPPER | 16 | Zee | 374 | 2.704 | U |
| UPPER | 17 | Zee | 317.5 | 2.487 | U |
| UPPER | 18 | Zee | 261 | 2.266 | U |
| UPPER | 19 | Zee | 204.3 | 2.038 | U |
| UPPER | 20 | Zee | 204.5 | 2.043 | U |
| UPPER | 21 | Zee | 108 | 0.298 | U |
| UPPER | 22 | Zee | 89.7 | 0.268 | S |
| UPPER | 23 | Zee | 64.3 | 0.214 | S |
| UPPER | 24 | Zee | 43.3 | -0.099 | S |
| UPPER | 25 | Zee | 28 | -0.062 | U |
| LOWER | 1 | Zee | 141.5 | -0.503 | S |
| LOWER | 2 | Zee | 207.1 | -0.915 | U |
| LOWER | 3 | Zee | 280.5 | -1.279 | U |
| LOWER | 4 | Zee | 343.8 | -1.618 | U |
| LOWER | 5 | Zee | 398.9 | -1.745 | U |
| LOWER | 6 | Splice | 446.6 | -1.861 | S |
| LOWER | 7 | Zee | 520.1 | -2.02 | U |
| LOWER | 8 | Coaming | 547.5 | -1.986 | U |
| LOWER | 9 | Coaming | 547.5 | -1.928 | U |
| LOWER | 10 | Zee | 511.7 | -1.989 | U |
| LOWER | 11 | Splice | 426.6 | -1.84 | U |
| LOWER | 12 | Zee | 345.9 | -1.778 | U |
| LOWER | 13 | Zee | 261.5 | -1.633 | U |
| LOWER | 14 | Zee | 177.2 | -1.763 | S |
| LOWER | 15 | Zee | 97.9 | -1.541 | U |
| LOWER | 16 | Zee | 85.4 | -1.34 | U |
| LOWER | 17 | Zee | 57.3 | -0.792 | U |
| LOWER | 18 | Zee | 29.1 | -0.255 | U |

FIG. 9

METHOD FOR FORMING A METAL BEAM OR STRINGER

This Application is a continuation of and claims the benefit of the priority of U.S. patent application Ser. No. 14/851,498 filed Sep. 11, 2015, entitled "STRINGER FORMING DEVICE AND METHODS OF USING THE SAME," which is hereby incorporated herein by reference in its entirety.

FIELD OF THE INVENTION

The present invention relates generally to a method for bending metal beams and more particularly, but not exclusively, to a method for forming aircraft stringers having either unsymmetric or symmetric cross-sections.

BACKGROUND OF THE INVENTION

Aircraft wings have stiffening elements, called stringers, attached to the inside surfaces of the upper and lower skins to give them bending resistance. The stringers run from root to tip along the span of the wing and must be bent to match the contour of the wing. The bending of the stringers allows for their attachment to the wing skins without introducing loads or stress into the assembly during riveting.

Traditionally, aircraft stringers have been formed in a hydraulic press using 3-point bending. The manual production of stringers is slow, requires a significant degree of operator expertise, requires frequent checks of part contour to determine where additional bends or "hits" are required, and has a significant scrap rate as parts are frequently damaged due to overloads.

The manual bending process takes at least two men to perform and the longest parts require two hours to form. Moreover, stringers are not formed in batches of the same part number, but are formed in ship sets so that a complete left hand and right hand set of parts are formed before repeating any particular part number.

In the manually applied bending process, the operator first makes marks along the length of the part at a set interval with a grease pencil. These marks are used to determine where the part will be deflected with a hydraulic ram. The operator will then place the flat part against the contour template and measure the gap between the straight part and template to indicate how much contour is needed at a particular location. The part may then be loaded into the press and moved to the first index mark, clamped to prevent movement, and then the hydraulic ram is brought down against the part to provide a permanent deflection. The part is then indexed to the next mark, clamped, and deflected by the ram. Periodically, the part will be taken out of the press and placed on an inspection table for the contour to be checked against the template. Gap measurements will be taken, additional marks will be made on the part where the gaps are outside of the forming tolerance, and the part will be put back in the press for additional hits. The process is iterative, involving many trips back and forth from the press to the inspection table.

Accordingly, there is a need in the field for a metal beam forming apparatus and method that allows for automated bending of metal beams. A fully or partially automated solution is desired that reduces costs due to loss, does not require the same level of operator expertise, lowers the risk of part damage due to overload, and cuts the two hour cycle time by at least one-half.

SUMMARY OF THE INVENTION

The present invention meets the needs in the field by providing an automated apparatus and method for forming metal beams, such as aircraft stringers.

In a first aspect, the present invention includes an apparatus for forming a metal beam. The apparatus may include a platform and a fixed clamp member that may be connected to the platform. The fixed clamp member may include a first locking clamp for releasably locking a first portion of the metal beam.

The apparatus may also include a bending clamp member that is connected to the platform and positioned adjacent to the fixed clamp member. The bending clamp member may include a rotatable bending frame having a second locking clamp for releasably locking a second portion of the metal beam. The bending clamp member may also include a first bend actuator connected to the rotatable bending frame that may be configured to apply a first bending force to the rotatable bending frame. The bending clamp member may include a second bend actuator connected to the rotatable bending frame and may be configured to apply a second bending force to the rotatable bending frame. For instance, the second bending force may be applied on an axis substantially perpendicular to the axis of the first bending force. The first bending force and second bending force may be provided in approximately a 2:1 ratio, respectively.

Additionally, the bending clamp member may include a linkage assembly that may be interposed between the first bend actuator and the rotatable bending frame. The linkage assembly may be provided to translate the first bending force to the rotatable bending frame and modulate the angle at which the first bending force is applied to the rotatable bending frame.

The present invention may also include a method of bending a metal beam having a shear center and at least one principal axis with a metal beam forming apparatus to provide a deflected metal beam.

The method of the invention may include the step of inserting the metal beam into a fixed clamp member and bending clamp member of the metal beam forming apparatus. The method may also include the step of clamping a first portion of the metal beam in the fixed clamp member and clamping a second portion of the metal beam in the second clamp member. Furthermore, the method may include bending the metal beam through its shear center and along at least one principal axis by: applying a first bending force to the metal beam with a first bend actuator; detecting twisting of the metal beam and, if twisting is detected, modulating the angle at which the first bending force is applied with a linkage assembly until no twisting detected; and applying a second bending force to the metal beam with the second bend actuator, wherein the first bending force and the second bending force combine to bend the metal beam along the at least one principal axis. The methods of the invention may then include the step of receiving the deflected metal beam from the metal beam forming apparatus.

Further, a method for forming a metal beam may comprise: clamping a first portion of the metal beam in a substantially fixed position; clamping a second portion of the metal beam in a position whereat the metal beam is rotatable about three axes in reaction to a bending force; applying a first bending force to the clamped second portion of the metal beam in a first direction; applying a second bending force to the clamped second portion of the metal beam in a second direction that is substantially perpendicular to the first bending force, wherein the first and second bending forces produce a net bending force; sensing twisting of the second portion of the metal beam resulting from applying the first and second bending forces; and translating the first bending force in a direction that is transverse to the first direction and that reduces the twisting of the metal beam. The net bending force tends to be moved toward the shear center and toward being along the principal axis of the metal beam.

Additionally, a method for forming a metal beam may comprise: clamping first and second portions of the metal beam in a substantially fixed and in a position whereat the metal beam is rotatable about three axes; applying a net bending force to the clamped second portion of the metal beam at a predetermined angle; sensing twisting of the second portion of the metal beam resulting from the net bending force; and modulating the angle at which the net force is applied to reduce the twisting of the metal beam. As a result, the net bending force is moved toward the shear center and toward being along the principal axis of the metal beam.

Still further, a method of bending a metal beam having a shear center and at least one principal axis to provide a deflected metal beam, may comprise: inserting the metal beam into a fixed clamp member and a bending clamp member; clamping a first portion of the metal beam in the fixed clamp member and clamping a second portion of the metal beam in the bending clamp member; bending the metal beam through its shear center and along at least one principal axis by: applying a bending force to deflect the metal beam; detecting twisting of the metal beam and, if twisting is detected, modulating the angle at which the bending force is applied in a direction to reduce twisting of the metal beam; and applying a second bending force at the modulated angle to deflect the metal beam to bend the metal beam along the at least one principal axis; and receiving the bent metal beam.

BRIEF DESCRIPTION OF THE DRAWINGS

The foregoing summary and the following detailed description of the exemplary embodiments of the present invention may be further understood when read in conjunction with the appended drawings, in which:

FIG. 9 illustrates a table that describes exemplary forming parameters for a set of aircraft stringers.

DETAILED DESCRIPTION OF THE INVENTION

Figure 1:
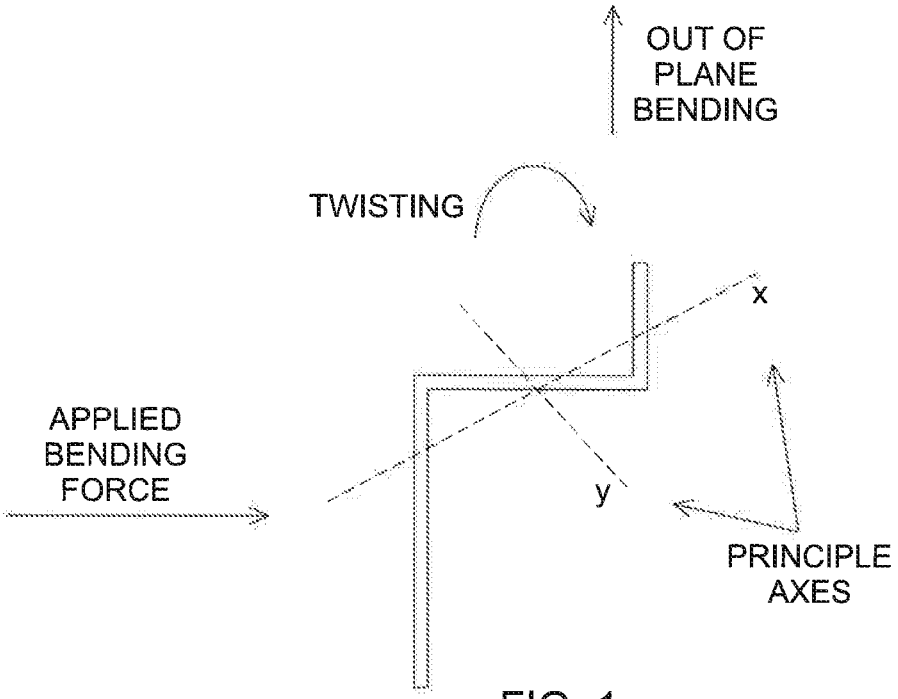
FIG. 1 schematically illustrates a diagram of a metal beam having a Z-shaped cross-section and the associated principal axes.

A variety of industries, such as the aerospace industry, require formed metal beams that are produced through a number of bending processes. As described above, the aerospace industry uses stringers, which are metal beams that support wing surfaces and must take on the contour of the wing surfaces. Many stringer cross-sections are unsymmetrical. However, certain aircraft stringers may have a Z-shaped cross-section, an I-shaped cross-section, a J-shaped cross-section, or a channel (U-shaped) cross-section. Because of the lack of symmetry, when a forming load is applied to a metal beam the shape may deflect out of plane (see FIG. 1). This out of plane deformation must be either controlled, as in the device of the invention, or it must be corrected to return to the part to a straight condition. When the manual forming methods described above are used, the part is rotated into the press on its side, and the out of plane deformation is corrected.

The applied forming loads can also distort the flanges of the part leaving permanent deformations or "kinks" in them. The flanges can also bend and cause the angle between the flange and web to change. These permanent deformations must be prevented or taken out of the finished part using hand tools.

When bending a metal beam, the cross-section of the beam can determine whether an applied force may result in out of plane bending or twisting (torsion) of the metal beam. In order to prevent out of plane bending and twisting, a bending method and device must account for the shear center and principal axes of the metal beam during forming processes.

To avoid twisting of the metal beam during the application of force, the plane of bending must pass through the shear center of the metal beam cross-section. As used herein, the term "shear center" describes a point associated with the cross-section of a metal beam through which the plane of an external force can act without introducing torsional loads, and a resulting twist, to the metal beam during forming processes. Accordingly, a bending force applied through the shear center of a metal beam will result in bending without torsion.

To avoid out of plane bending of a metal beam during the application of force, the plane of force must be provided along a principal axis of the metal beam cross-section. As used herein, the term "principal axis" describes an axis for which the product of inertia for a cross-section is zero. Therefore, if an applied load does not coincide with a principal axis of a metal beam cross-section, bending will take place in a plane that is different from the plane of the principal axis (i.e., out of plane bending). Accordingly, a bending force applied along a principal axis of a metal beam will result in bending that is limited to the principal axis.

Due to the varying cross-sections of the metal beams formed by the devices and processes of the invention, such metal beams may display varying principal axes and shear centers. For example, Z-shaped metal beams are unsymmetrical and have two principal axes (y and x) (see FIG. 1).

The devices and methods of the invention are designed to provide bending forces to the metal beams while accounting for the shear center and the various principal axes. In preferred aspects of the invention, the devices described herein may provide bending forces with two actuators (first and second actuators). As bending forces are applied to a metal beam, the devices and methods of the invention (1) adjust the angle at which a first force is applied from the first actuator to control twisting by ensuring that the plane of force is applied through the shear center of the metal beam; and (2) providing a second force that combines with the first to produce a net force that acts along a principal axis of the metal beam.

Figure 2:
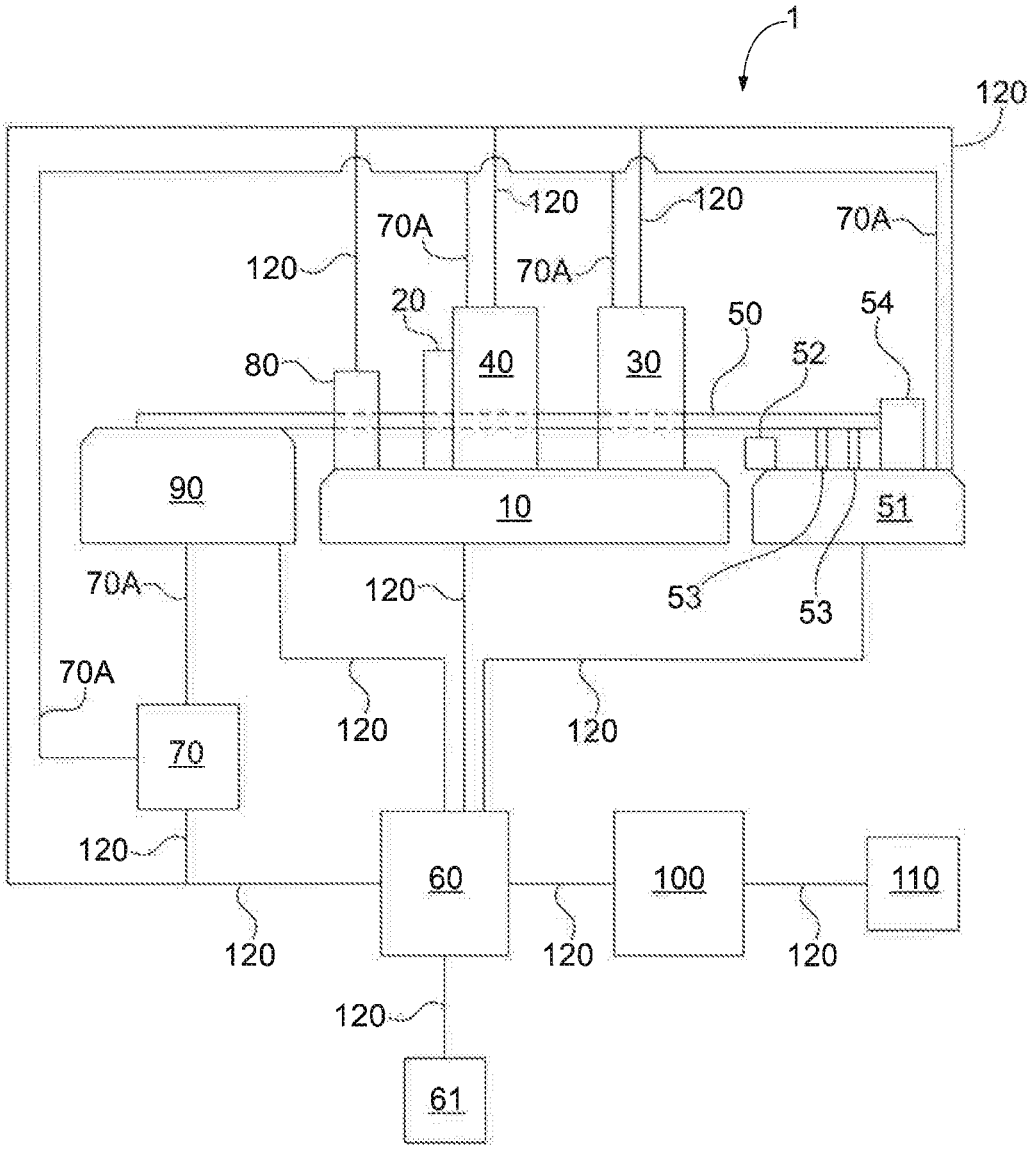
FIG. 2 schematically illustrates a metal beam forming apparatus of the invention.
Figure 3:
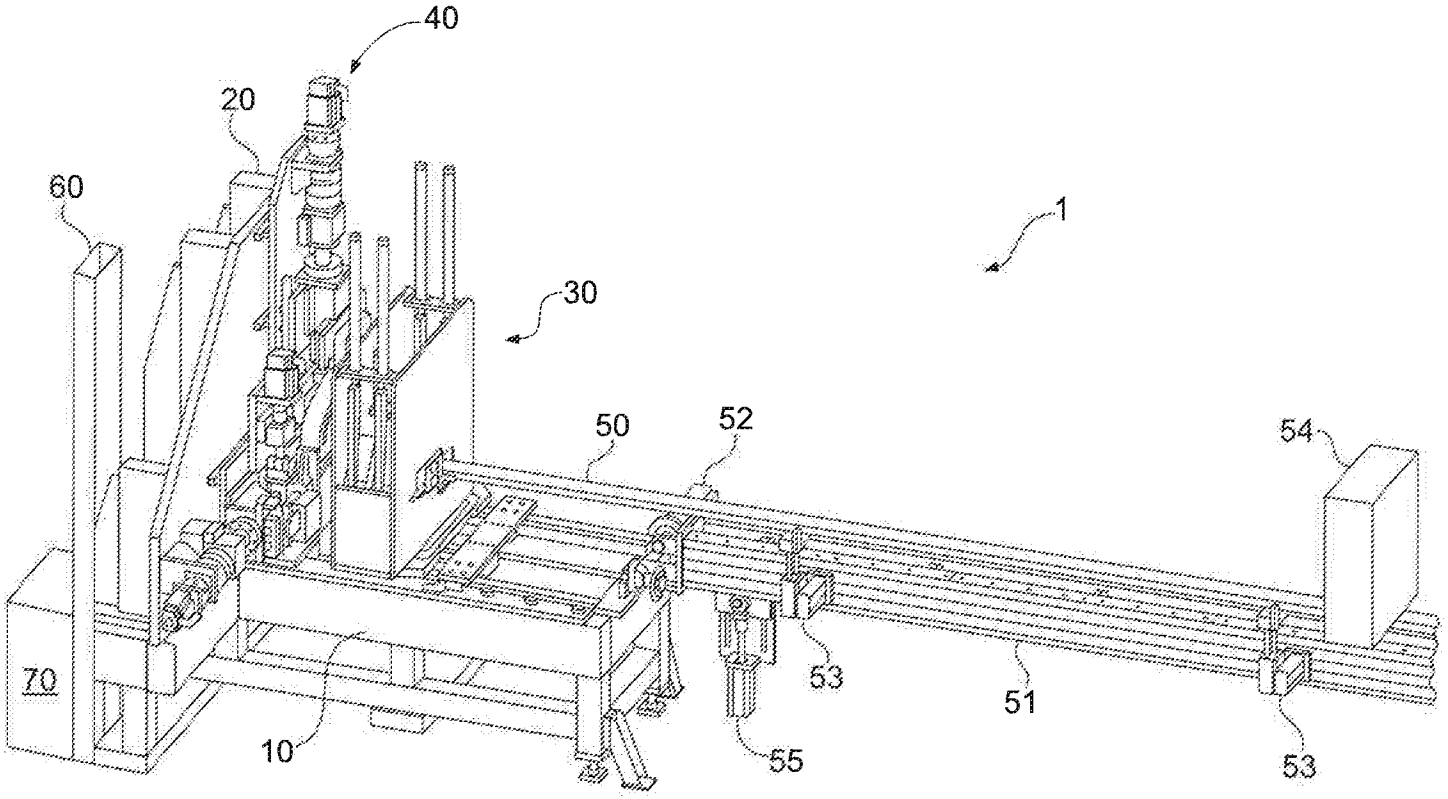
FIG. 3 schematically illustrates an exemplary metal beam forming apparatus of the invention.

Referring now to the figures, wherein like elements are numbered alike throughout, FIGS. 2 and 3 provide an apparatus 1 for forming or otherwise bending a metal beam 50. The apparatus 1 may include a platform 10 and a perpendicular support structure 20 that supports the various bending and forming elements of the apparatus (e.g., the bending clamp member 40). The apparatus 1 may include (1) a fixed clamp member 30 that may be connected to the platform 10; and (2) a bending clamp member 40 that may be connected to the platform 10 and which may be adjacent to the fixed clamp member 30. The bending clamp member 40 may also be attached to the perpendicular support structure 20. Furthermore, the apparatus 1 may include a metal beam cradle 51 that may support a portion of the metal beam 50 during the forming processes. The metal beam cradle 51 may also advance the metal beam 50 into the fixed clamp member 30 and bending clamp member 40.

In other aspects, the apparatus 1 may include a control system 60 for controlling the apparatus 1 and communicating with and/or operating the fixed clamp member 30, the bending clamp member 40, and the metal beam cradle 51. The apparatus 1 may also include an actuator supply unit 70 configured to power the various actuators disposed on the apparatus 1. As shown in FIG. 2, the actuator supply unit 70 may be in fluid communication with the various actuators of the invention through supply lines 70A. The supply lines 70A may be pneumatic supply lines, hydraulic supply lines, or a combination thereof.

Additionally, the apparatus 1 may include a contour inspection system 80 that measures the contour of the formed or bended metal beam to determine if the metal beam is within tolerances after forming.

The metal beams 50 formed by the apparatus 1 may be symmetrical or unsymmetrical. However, various metal beams may be formed by the devices and processes of the invention including, but not limited to, metal beams having an I-shaped cross-section, a Z-shaped cross-section, a J-shaped cross-section, a T-shaped cross-section, an L-shaped cross-section, a U-shaped cross-section, or a combination thereof. In certain embodiments, the metal beams formed by the devices and processes of the invention are metal beams having Z-shaped cross-sections. In addition, the metal beams of the invention may be aircraft stringers. Exemplary apparatus 1 of FIGS. 2-7 is configured to form a metal beam having a Z-shaped cross-section.

The apparatus and methods of the invention may be used to form any beam, for example metal beam 50, that includes a metal alloy or other material that exhibits plastic deformation when loaded above its proportional limit. The proportional limit may be defined as the maximum stress for which stress remains proportional to strain and permanent deformation may begin to occur. For example, the metal alloys of the invention (e.g., those alloys used in metal beam 50) may be selected from the group consisting of an aluminum alloy, a titanium alloy, a magnesium alloy, a steel alloy, and a combination thereof.

Figure 4:
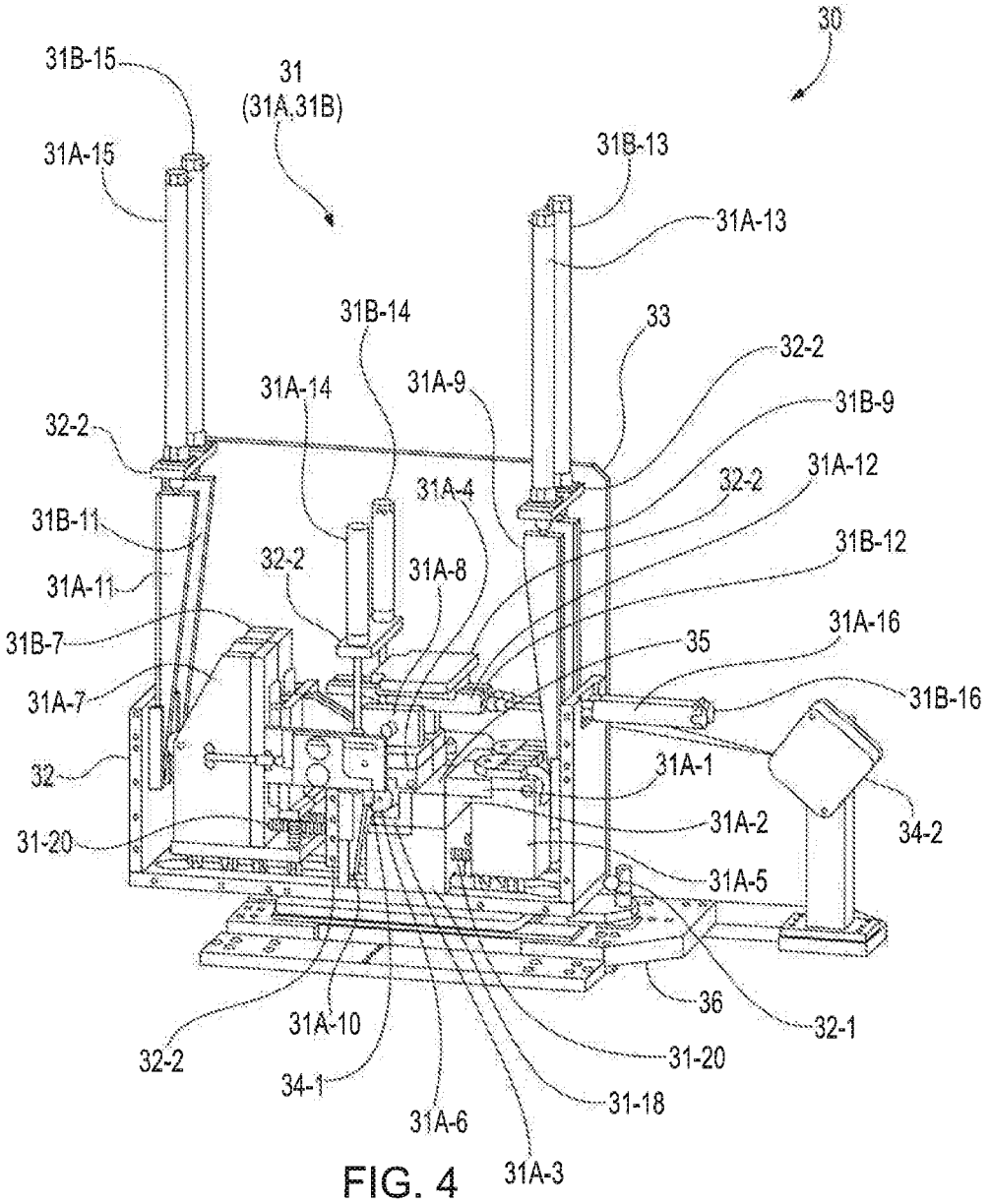
FIG. 4 schematically illustrates an exemplary fixed clamp member of the metal beam forming apparatus illustrated in FIG. 3.

Regarding the specific bending components of the invention, apparatus 1 includes a fixed clamp 30 that may be connected to the platform 10. As shown in FIG. 4, fixed clamp 30 may include a first locking clamp 31 that is contained within a housing 32. The housing 32 may also be connected to one or two face plates 33 that enclose the components of the first locking clamp 31 and provide mounting surfaces for the various components within the fixed clamp member 30. Housing 32 and face plates 33 may provide an enclosure, which may be mounted to bracket 36. Bracket 36 may be one or more plates that connect the fixed clamp member 30 to the platform 10.

The first locking clamp 31 allows the fixed clamp member 30 to secure a portion of the metal beam that is to be formed by the apparatus 1. A variety of different locking systems may be used in accordance with the invention to secure a first portion of a metal beam in the fixed clamp member 30. Preferably, the locking clamps of the invention are configured to lock a portion of the metal beam (e.g., two or more surfaces of the metal beam) in frictional engagement. As described herein, the locking clamps of the invention may include one or more fastening devices that secure the metal beam at the fixed clamp member 30 (or bending clamp member 40) to prevent movement or separation during forming processes through the application of pressure on the metal beam between at least two opposing surfaces of the locking clamp. The locking clamps of the invention may include hand powered clamps or vices. However, in preferred aspects, the locking clamps of the invention include clamps that are powered by one or more actuators.

For example, the actuators of the invention may include pneumatic actuators, screw driven actuators, electrical actuators, manual (e.g., hand turned) actuators, spring actuators, hydraulic actuators, or a combination thereof. In a particularly preferred embodiment of the invention, the locking clamps are driven by combination pneumatic/hydraulic actuators (e.g., air over oil actuators). Each of the actuators described herein may be connected to the control system 60 (either through a wireless or wired connection) with a transceiver that is programmed to (1) receive commands from the control system 60; and (2) transmit status information to the control system 60 regarding the status of the actuator.

The first locking clamp 31 may include a first aperture 35, which is a space in which the metal beam may pass when the locking clamp 31 is in its open configuration. As a point of reference, first locking clamp 31 of FIG. 4 is shown in its open configuration.

In certain embodiments of the invention, first locking clamp 31 may include two or more locking shoe assemblies for locking the position of a portion of the metal beam. Each locking shoe assembly may include (1) a shoe that abuts a surface of the metal beam and includes a deformable or nondeformable surface (e.g., a nondeformable metal surface); (2) an actuator; and (3) a driving member that translates force from the actuator to the shoe, which may be: a rod, a wedge and rolling block, a wedge and sliding block, or a combination thereof. Specifically, the first locking clamp 31 may include two opposing shoes and/or shoe assemblies. In another embodiment, the first locking clamp 31 may include three opposing shoes and/or shoe assemblies. Preferably, the first locking clamp 31 includes four opposing shoes and/or shoe assemblies.

As shown in FIG. 4, an exemplary locking clamp 31 may include two locking clamps (i.e., locking clamp 31A and locking clamp 31B) where each locking clamp 31A, 31B includes four shoe assemblies. Two or more locking clamps may be used for locking clamp 31 where the metal beam does not include a uniform shape along its length. Accordingly, using two locking clamps 31A, 31B allow the device to account for small variances in metal beam shape to ensure that the necessary frictional engagement is formed at the fixed clamp member 30. However, for the purposes of FIG. 4, the components of locking clamps 31A and 31B are identical. Therefore, a locking clamp component labeled "31A" will have an identical component for locking clamp 31B, and vice versa, for the embodiment of the invention set forth in FIG. 4.

Specifically, locking clamp 31A of FIG. 4 includes shoes 31A-1, 31A-2, 31A-3, and 31A-4, which are connected to driving members (i.e., sliding blocks 31A-5, 31A-6, 31A-7, and 31A-8, and wedges 31A-9, 31A-10, 31A-11, and 31A-12) powered by actuators 31A-13, 31A-14, 31A-15, and 31A-16. The configuration for the above referenced components of locking clamp 31 for the fixed clamp member 30 are configured to accommodate a metal beam having a Z-shaped cross-section. However, it is understood that a person having ordinary skill in the art could reconfigure locking clamp 31, in view of the present specification, to accommodate metal beams having an I-shaped cross-section, a Z-shaped cross-section, a J-shaped cross-section, a T-shaped cross-section, an L-shaped cross-section, or a U-shaped cross-section.

Shoe 31A-1 is connected to rolling block 31A-5. Rolling block 31A-5 is slidably connected to a track on the housing 32 and also includes a wheel for engaging with a wedge 31A-9. Wedge 31A-9 is connected to actuator 31A-13 via a piston of the actuator 31A-13. When the actuator 31A-13 extends its piston, wedge 31A-9 also extends, which drives the rolling block 31A-5 and shoe 31A-1 into frictional engagement with a surface of the metal beam in the aperture 35.

Shoe 31A-2 is connected to support structure 31-18, which is fixed to the housing 32. Accordingly, shoe 31A-2 may function as an anvil upon which other shoes (i.e., 31A-3, and 31A-4) may act.

Shoe 31A-3 is connected to rolling block 31A-6. Rolling block 31A-6 is slidably connected to a track on the face plate 33 and also includes a wheel for engaging with a wedge 31A-10. Wedge 31A-10 is connected to actuator 31A-14 via a piston of the actuator 31A-14. When the actuator 31A-14 extends its piston, wedge 31A-10 also extends, which drives the rolling block 31A-6 and shoe 31A-3 into frictional engagement with a surface of the metal beam in the aperture 35.

Shoe 31A-4 is connected to rolling blocks 31A-7 and 31A-8. Shoes 31A-1 and 31A-3 each provide a one dimensional line of force and move in opposite directions. However, shoe 31A-4 is configured to provide a two dimensional line of force and may move diagonally as compared to the movement of shoes 31A-1 and 31A-3. Rolling block 31A-7 is slidably connected to a track on housing 32 and also includes a wheel for engaging with a wedge 31A-11. Wedge 31A-11 is connected to actuator 31A-15 via a piston of the actuator 31A-15. When the actuator 31A-15 extends its piston, wedge 31A-11 also extends, which drives the rolling block 31A-7 and shoe 31A-4 into frictional engagement with a surface of the metal beam in the aperture 35 on a first axis. Rolling block 31A-8 is slidably connected to a track on the face plate 33 and also includes a wheel for engaging with a wedge 31A-12. Wedge 31A-12 is connected to actuator 31A-16 via a piston of the actuator 31A-16. When the actuator 31A-16 extends its piston, wedge 31A-12 also extends, which drives the rolling block 31A-8 and shoe 31A-4 into frictional engagement with a surface of the metal beam in the aperture 35 on a second axis.

The shoes and/or shoe assemblies of the first locking clamp 31 may be extended simultaneously or sequentially. The shoes and/or shoe assemblies of the first locking clamp 31 may have the ability to apply a restraining load on a portion of the metal beam to simulate hand pressure. The loading range may be from 1 to 100 lbs. The specific loading may be programmable and controlled at the control system 60 through the user interface 61. The purpose of the loading is to simulate hand pressure and take out minimal amounts of warp from the metal beam to provide a more reliable displacement reading both during and after bending.

Furthermore, where a device of the invention utilizes a wedge and rolling block or wedge and sliding block component, minimal restraining loads may be provided to the metal beam while maintaining large amounts of resistance to prevent "backing out" of the shoes during forming. Moreover, the use of wedge and rolling block or wedge and sliding block components minimizes the loads placed on the various actuators described above when clamping the metal beam.

The locking clamp 31 may also include several springs 31-20 placed between the supports 31-18 or 32-2, for example, and a rolling block in order to provide a retracting force for the rolling blocks when the clamp is unlocked.

Regarding the housing 32, the housing may include a locking knob 32-1 for fixing the position of the housing 32 on the bracket 36. Indeed, in certain embodiments of the invention, the housing 32 may include a pivot point that allows the housing 32 to be rotated about the bracket 36.

The housing 32 may include supports 32-2 for mounting and/or supporting various components of the first locking clamp 31, including: wedges 31A-10 and 31A-12; and actuators 31A-14, 31A-15, and 31A-16. In addition, housing 32 may have one or more tracks for guiding and supporting wedges 31A-9 and 31A-11

Additionally, the fixed clamp member 30 may include one or two follower assemblies 34-1. The follower assemblies may be placed proximate to the aperture 35 and may include a follower arm that may abut a surface of the metal beam. The follower measures one plane of deflection of the metal beam during forming. The follower may include a sensor that measures the amount of metal beam deflection during bending in the plane of deflection and converts that measurement into an analog or digital signal. The sensor may be connected to the control system 60 (either through a wireless or wired connection) and may send the digital signal that is representative of the metal beam deflection to the control system 60. In preferred embodiments of the invention, the fixed clamp member includes two followers 34-1 that are placed in the input and output sides of the fixed clamp member 30, proximate to the aperture 35.

Fixed clamp member 30 may also include a displacement sensor assembly 34-2 that may be connected to the bracket 36. Displacement sensor assembly 34-2 may include one or more lasers that may be connected to the control system 60 and may be targeted at the metal beam 50, at a reflective target placed on the metal beam 50, or on a follower that abuts the metal beam 50. The one or more lasers may measure the displacement of metal beam 50 during bending processes and transmit sensor data to the control system 60 that may be indicative of the amount of displacement in the metal beam 50 during and after bending. For example, the displacement sensor assembly 34-2 may measure lateral displacement of the metal beam 50 during and after bending of the metal beam 50. In preferred embodiments of the invention, the displacement sensor assembly 34-2 may include a laser that is targeted at a follower that abuts the metal beam 50 where the follower allows a measurement to be made from a stand-off distance or offset to provide clearance for the laser to have an unobstructed view of the target on the follower.

Figure 5:
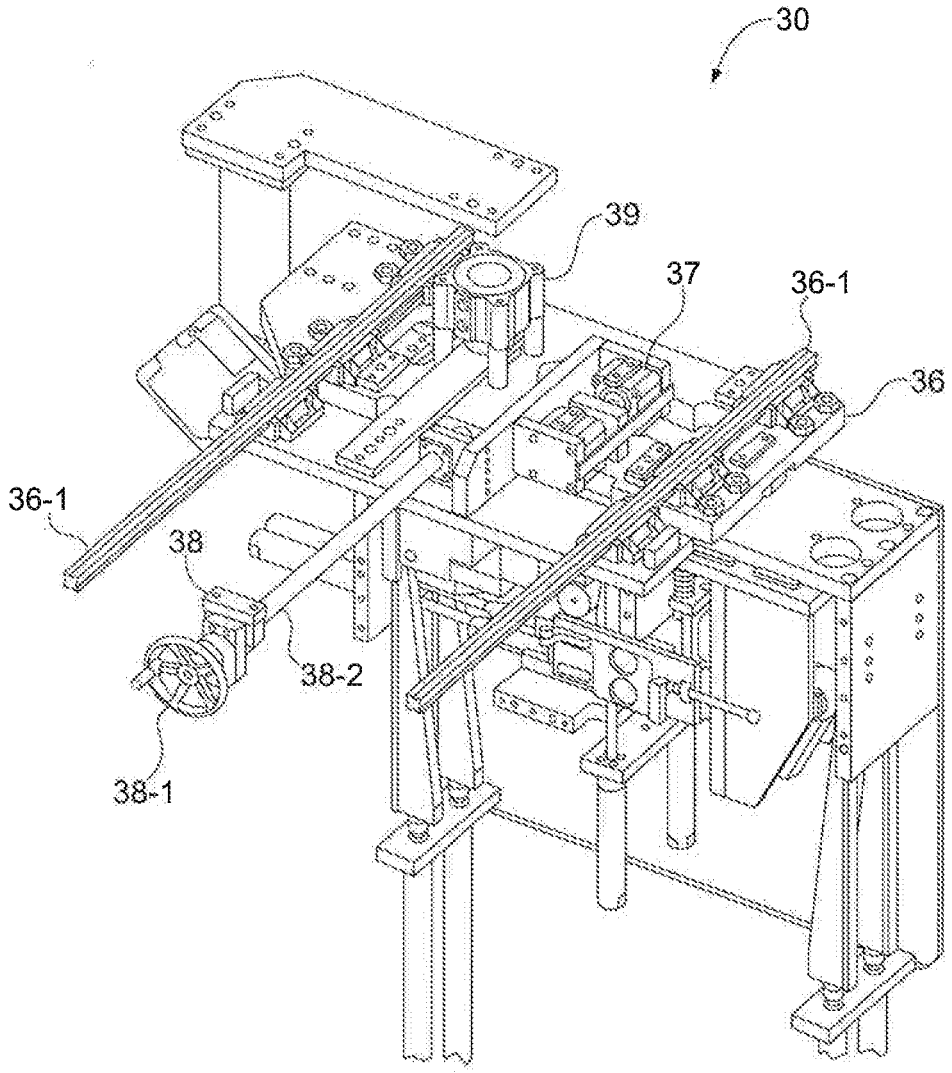
FIG. 5 schematically illustrates the underside of the exemplary fixed clamp member illustrated in FIG. 4.

The underside of the fixed clamp member 30 is shown in FIG. 5. Attached to the underside of bracket 36 are a set of guide rail assemblies 36-1, which also connect to platform 10. The position of fixed clamp member 30 may be adjusted, with respect to platform 10 by adjusting screw 38. Screw 38 is fixed to the platform 10 at bracket 38-3 and includes an adjustment knob 38-1 and threaded shaft 38-2. Accordingly, rotation of knob 38-1 allows the position of fixed clamp member to be varied with respect to both the platform 10 and the bending clamp member 40. Furthermore, the bracket 36 may include a locking actuator 39 that locks bracket 36 in position after any adjustment or positioning with respect to the platform 10 and bending clamp member 40.

Depending upon the type of bends or hits required by the apparatus 1, the distance between the fixed clamp member 30 and bending clamp member 40 may require adjustment. For example, in certain aspects of the invention, the distance between the fixed clamp member 30 and the bending clamp member 40 may be about 1 to 24 inches. However, in a preferred embodiment, the distance between the fixed clamp member 30 and the bending clamp member 40 may be about 4 to 22 inches.

The bracket 36 may include a drift member 37. The drift member 37 may include a pair of actuators (e.g., solenoids) with a rod interposed between the pair of actuators that is connected to the housing 32. The drift member 37 allows the fixed clamp member 30 to drift, while providing some resistance, toward or away from the bending clamp member 40 during bending processes. It is understood that the application of bending forces at the bending clamp member 40 may result in a pulling force on the metal beam. The drift member 37 relieves the stress that might otherwise be caused by this pulling force by allowing the fixed clamp member to drift. Indeed, the drift member 37 allows for compliance in the fixed clamp member 30 and provides one degree of freedom to keep the metal beam 50 from "thinning" as it is bent with an apparatus of the invention. In other embodiments, the drift member 37 may be a set of springs or a piece of elastic material (e.g., a rubber pad).

Figure 6:
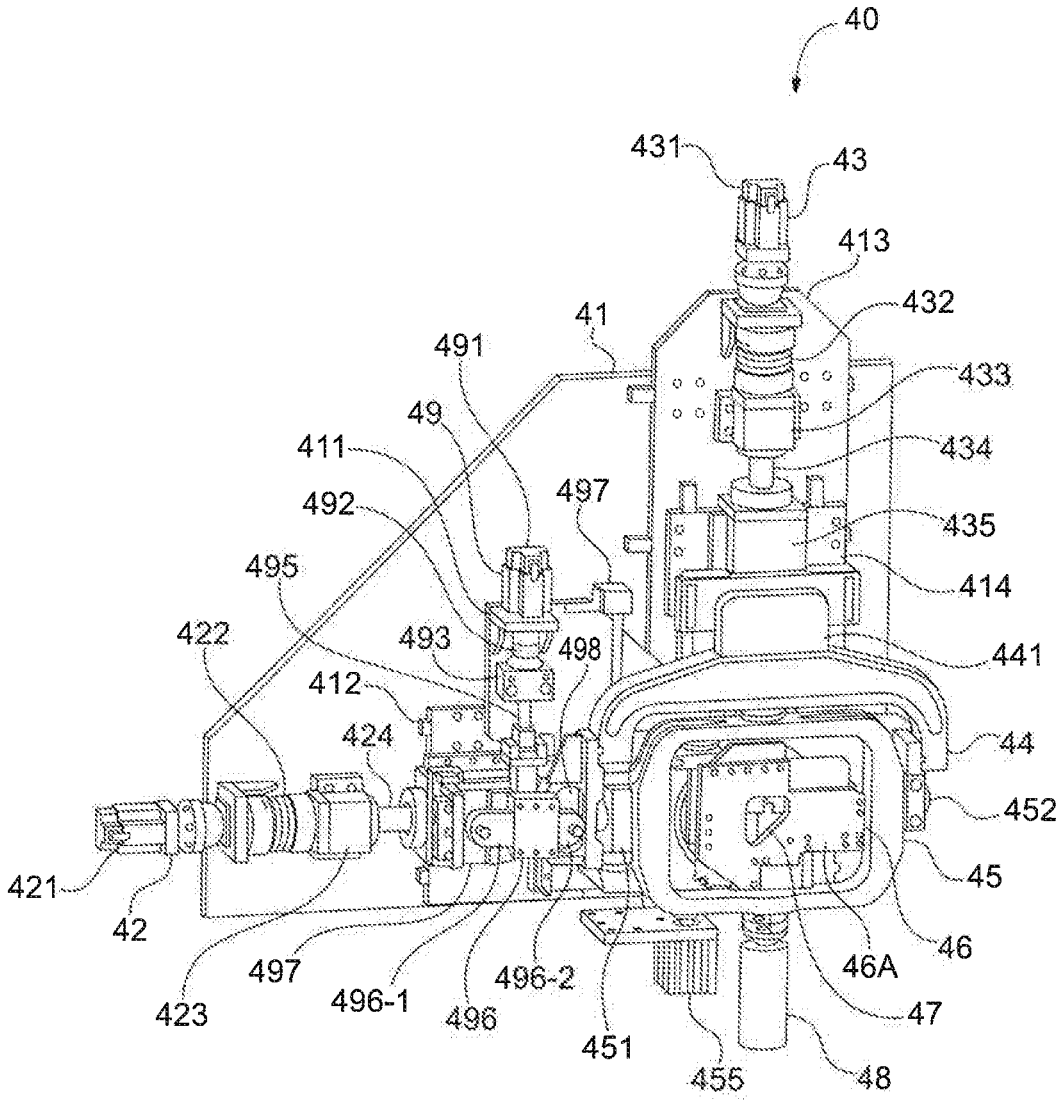
FIG. 6 schematically illustrates an exemplary bending clamp member of the metal beam forming apparatus illustrated in FIG. 3.

An exemplary bending clamp member 40 is shown in FIG. 6. The bending clamp member 40 is provided to (1) lock a portion of the metal beam at a locking clamp; and (2) bend the metal beam with two or more bend actuators. The bending clamp member 40 may include a support structure 41 and a first bend actuator 42, second bend actuator 43, and linkage assembly 49 connected to the support structure 41. The bending clamp member 40 may also include a rotatable bending frame 44.

Both the first bend actuator 42 and the second bend actuator 43 may be connected to the rotatable bending frame 44 and may provide bending forces to the rotatable bending frame 44 that may be substantially perpendicular to each other. In addition, the linkage assembly 49 may be interposed between the first bend actuator 42 and the rotatable bending frame 44. The linkage assembly 49 may translate a first bending force from the first bend actuator 42 to the rotatable bending frame 44. Moreover, the linkage assembly 49 may modulate the angle at which the first bending force is applied to the rotatable bending frame 44.

The rotatable bending frame 44 may be connected to a gimbal 45, which has a second locking clamp 46 disposed therein for locking a portion of the metal beam during bending processes.

Regarding the components of the bending clamp member 40 more particularly, the first bend actuator 42 and second bend actuator 43 may be described as a horizontal bend actuator and vertical bend actuator, respectively, as compared to the ground. However, a person having ordinary skill in the art would recognize, in view of this specification, that a variety of orientations for the first bend actuator 42 may be used. In certain embodiments, the first bend actuator 42 may be provided on an axis that is substantially perpendicular to the axis of the second bend actuator 43.

The first bend actuator 42 provides a first bending force to the rotatable bending frame 44 and, therefore, provides a force to the metal beam that is locked in the second locking clamp 46, which is mounted in the gimbal 45. As would be understood by a person having ordinary skill in the art, the first bend actuator 42 may include: an electric screw actuator, a hydraulic actuator, a pneumatic actuator, or a combination thereof. Indeed, a variety of actuators may be used to provide a first bending force to the rotatable bending frame 44 in accordance with the invention.

In a specific embodiment, the first bend actuator 42 may include an actuator 421, a spacer 422, a mounting bracket 423, and a rod 424 (e.g., a threaded rod). The actuator 421 is an electric motor and servo for turning rod 424, which is preferably a threaded rod, to provide a first bending force. For example, actuator 421 and rod 424 may encompass a ball screw drive. The first bend actuator 42 is connected to the rotatable bending frame 44 via a linkage assembly 49. Linkage assembly 49 is mounted to support structure 41 through auxiliary support 411.

The linkage assembly 49 may include an actuator, a traveler, and a shaft connecting the actuator and the traveler. The traveler of the linkage assembly 49 may connect the first bending clamp 42 to the rotatable bending frame 44. As described above, a metal beam will twist if the bending force is not applied in a plane that passes through the shear center. When applying a bending force in accordance with the present invention from the first bend actuator 42, the rotatable bending frame 44 is allowed to freely rotate as the metal beam begins to twist. This rotation may be sensed by one or more sensors on the device, which may then trigger the activation of the linkage assembly 49 through the control system 60. Indeed, upon twisting, the linkage assembly automatically raises or lowers the traveler with the actuator to adjust the angle of the bending force from the first bend actuator 42. The linkage assembly 49 may continue to adjust the bending force until no further twisting is detected in the rotatable bending frame. Accordingly, when no further twisting is detected during the application of the first bending force, it is understood that the line of force applied through the first bend actuator 42 is passing through the shear center of the metal beam.

In a specific embodiment, linkage assembly 49 may include an actuator 491, a spacer 492, a mounting bracket 493, a rod 495, and a traveler 496. As would be understood by a person having ordinary skill in the art, the linkage assembly 49 may include: an electric screw actuator, a hydraulic actuator, a pneumatic actuator, or a combination thereof. In a preferred embodiment, the actuator 492 is an electric motor and servo for turning rod 495, which is preferably a threaded rod, to adjust the position of the traveler 496 with respect to the axis of the first bend actuator 42.

The traveler 496 may include wheels 496-1 and 496-2, which are placed at either end of the traveler 496. Wheel 496-1 may connect with channel 497, which is located on movable plate 412. Moreover, the rod 424 may connect to movable plate 412, as shown in FIG. 6. Movable plate 412 is slidably connected to support structure 41 through a set of tracks. The tracks of support structure 41 and movable plate 412 allow the movable plate 412 to move with the rod 424 and thus translate the first bending force to the channel 497. Wheel 496-2 may connect with channel 498, which is located on the rotatable bending frame 44. Accordingly, movement of the movable plate 412 may be translated to the rotatable bending frame 44 through the traveler 496 and channels 497 and 498.

The linkage assembly 49 may include rotation sensor 497. Specifically, rotation sensor 497 may include a laser sensor that directs a laser on a target that is fixed to the rotatable bending frame 44 (not shown). As the rotatable bending frame 44 rotates, the rotation sensor 497 provides a signal to the control system 60 that is representative of such rotation. As described above, the control system 60 then activates the linkage assembly 49 to adjust the angle of the first bending force to provide a line of force that traverses the shear center of the metal beam. This angle is identified when the metal beam stops twisting.

The second bend actuator 43 provides a second bending force to the rotatable bending frame 44 and, therefore, provides a force to the metal beam that is locked in the second locking clamp 46, which is mounted in the gimbal 45. As would be understood by a person having ordinary skill in the art, the second bend actuator 43 may include: an electric screw actuator, a hydraulic actuator, a pneumatic actuator, or a combination thereof. Indeed, a variety of actuators may be used to provide a second bending force to the rotatable bending frame 44 in accordance with the invention. In preferred aspects, the first bending force and second bending force may be provided in a 2:1 ratio.

The second bend actuator 43 may include an actuator 431, a spacer 432, a mounting bracket 433, and a rod 434. The actuator 431 may be an electric motor and servo for turning rod 434, which is preferably a threaded rod, to provide a second bending force. The second bend actuator 43 may be mounted on support plate 413, which is connected to support structure 41 through a set of tracks. For example, the set of tracks connecting support plate 413 to support structure 41 allows for horizontal movement of the second bend actuator 43. As would be understood by a person having ordinary skill in the art, the position of the support plate 413 may be locked through a fastener, such as a screw, or may be allowed to drift during bending processes upon the application of force from the first bend actuator 42.

The present invention also includes a movable bracket 435, which is connected to rod 434. Movable bracket 435 is located on movable plate 414, which is slidably connected to support plate 413 through a set of tracks. The tracks of support plate 413 and movable plate 414 allow the movable plate 414 to move with the rod 434 and thus translate the second bending force to the rotatable bending frame 44. The movable bracket 435 may be connected to the rotatable bending frame 44 through pivot assembly 441.

Pivot assembly 441 includes a boss and a crescent channel where the boss may fit and slide within the crescent channel. For example, movable bracket 435 may include the boss and the rotatable bending frame 44 may include the crescent channel. The crescent channel may be configured to allow the rotatable bending frame 44 to rotate clockwise or counter clockwise, depending upon the rotation of the gimbal 45. The boss may be a metal protrusion or a wheel fixed to the movable bracket 435 or the rotatable bending frame 44. Preferably, the boss is fixed to the movable bracket 435.

The rotatable bending frame 44 is connected to the gimbal 45 at pivot points 451 and 452. Moreover, channel 498 is also connected to rotatable bending frame 44 at pivot point 451. As described herein, the rotatable bending frame 44 is provided to receive the first and second bending forces and translate those forces to the gimbal 45.

Gimbal 45, in conjunction with its connection to rotatable bending frame 44, allows the second locking clamp 46 to rotate about three axes of rotation. Specifically, the gimbal 45 is provided to allow a metal beam to rotate or bend freely during formation. Free movement may prevent additional stresses on the metal beam from out of plane bending forces or torsional forces produced during bending processes.

The locking clamp 46 may include one or more face plates 46A, which are provided to protect and support the internal components of the second locking clamp 46. Furthermore, the locking components of the locking clamp 46 define a second aperture 47 through which the metal beam may pass.

The gimbal 45 may also have a pneumatic or hydraulic cylinder 48 connected at a pivot point to provide pneumatic or hydraulic pressure, as necessary, to any pneumatic and/or hydraulic actuators in the second locking clamp 46.

The gimbal 45 may also be connected to one or more counter balance actuators, such as actuator 455, which may be provided to offset the weight and inertia of the gimbal 45. The one or more counter balances may allow the gimbal 45 and/or the rotatable bending frame 44 to move in response to either twisting or bending of the metal beam during bending processes.

Figure 7:
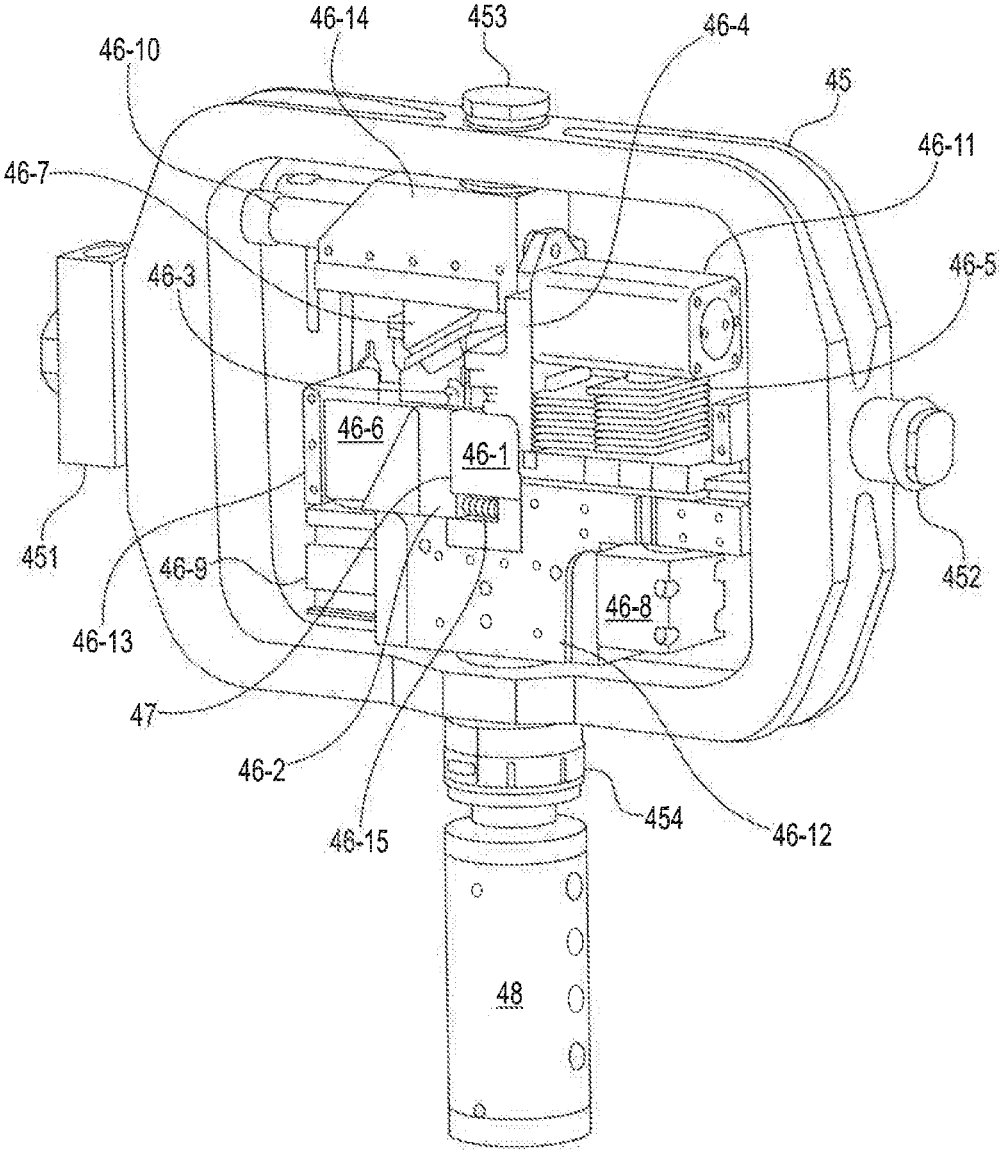
FIG. 7 schematically illustrates an exemplary locking clamp of the bending clamp member illustrated in FIG. 6.

The second locking clamp 46 is shown in greater detail in FIG. 7. The second locking clamp 46 may be rotatably connected to the gimbal 45 at pivot points 453 and 454.

The second locking clamp 46 may include two or more locking shoe assemblies for locking the position of a portion of the metal beam. Each locking shoe assembly may include (1) a shoe that abuts a surface of the metal beam and includes a deformable or nondeformable surface (e.g., a nondeformable metal surface); (2) an actuator; and (3) a driving member that translates force from the actuator to the shoe, which may be: a rod, a wedge and rolling block, a wedge and sliding block, or a combination thereof. Specifically, the second locking clamp 46 may include two opposing shoes or shoe assemblies.

In another embodiment, the second locking clamp 46 may include three opposing shoes or shoe assemblies. Preferably, the second locking clamp 46 includes four opposing shoes or shoe assemblies. Furthermore, the second locking clamp 46 may include two locking clamps. However, in certain embodiments, the second locking clamp 46 is a single locking clamp having four shoe assemblies. The second locking clamp 46 of FIG. 7 is shown in its closed configuration.

Specifically, the second locking clamp 46 of FIG. 7 includes shoes 46-1, 46-2, 46-3, and 46-4. The components of locking clamp 46 in the bending clamp member 40 are configured to accommodate a metal beam having a Z-shaped cross-section. However, it is understood that a person having ordinary skill in the art could reconfigure locking clamp 46, in view of the present specification, to accommodate metal beams having an I-shaped cross-section, a Z-shaped cross-section, a J-shaped cross-section, a T-shaped cross-section, an L-shaped cross-section, or a U-shaped cross-section.

Shoe 46-1 may be connected to support structure 46-12, which is fixed through a pivot 454 to cylinder 48. Moreover, support structure 46-12 is rotatably connected to the gimbal 45 through the pivot 45-4. Shoe 46-1 may function as an anvil upon which other shoes (i.e., 46-6 and 46-7) may act.

Shoe 46-2 is connected to sliding block and wedge assembly 46-6. The sliding block and wedge assembly is connected to a sliding track on support structure 46-13. As shown in FIG. 7, and as used herein, the "sliding block and wedge assembly" includes (1) a sliding block having a surface that abuts or is otherwise connected to the shoe and an angled surface; and (2) a wedge that is connected to a piston of an actuator, wherein the wedge is placed in contact with the angled surface of the sliding block and movement of the wedge results in movement of the sliding block. The wedge of the sliding block and wedge assembly 46-6 is connected to actuator 46-9 via a piston of the actuator 46-9. When the actuator 46-9 extends its piston, the sliding block and wedge assembly 46-6 disengages, which retracts the shoe 46-2. When the actuator 46-9 retracts its piston, the sliding block and wedge assembly 46-6 engages, which drives the shoe 46-2 into frictional engagement with a surface of the metal beam in the aperture 47.

Shoe 46-3 is connected to sliding block and wedge assembly 46-7. More specifically, shoe 46-3 is part of the sliding block in sliding block and wedge assembly 46-7. The sliding block and wedge assembly 46-7 is connected to a track on the support structure 46-14. The wedge of the sliding block and wedge assembly 46-7 is connected to actuator 46-10 via a piston of the actuator 46-10. When the actuator 46-10 extends its piston, the sliding block and wedge assembly engages, thereby frictionally engaging the shoe 46-3 with a surface of the metal beam in the aperture 47. When the actuator 46-10 retracts its piston, the sliding block and wedge assembly 46-7 disengages, thereby disengaging the shoe 46-3.

Shoe 46-4 is connected to an actuator 46-11 via a piston of the actuator 46-11. Furthermore, shoe 46-4 is connected to friction lock 46-5. Friction lock 46-5 is provided to fix the position of shoe 46-4 and prevent disengagement during bending processes. Friction lock 46-5 is composed of alternating plates (e.g., 15 alternating plates). Every other plate from the friction lock 46-5 is connected to the shoe 46-4. All the alternating plates are connected to actuator 46-8 via a piston of actuator 46-8. In one embodiment, when the actuator 46-8 activates to compress the plates together, the resulting friction between the plates locks the position of the shoe 46-4. For example, the actuator 46-8 could retract its piston, thereby compressing the alternating plates of the friction lock 46-5 where the piston passing through the plates terminates in a stopper at the distal end of the piston. As shown in FIG. 7, the actuators 46-8 and 46-9 are mounted to support structure 46-12. The piston of actuator 46-8 passes through support structure 46-12 and shoe 46-4 in order to attach to friction lock 46-5. Moreover, shoe 46-4 is slidably mounted to a track on support structure 46-12.

The shoes and/or shoe assemblies of the second locking clamp 46 may be extended simultaneously or sequentially. The shoes and/or shoe assemblies of the second locking clamp 46 may have the ability to apply a restraining load on a portion of the metal beam to simulate hand pressure. The loading range may be from 1 to 100 lbs. The specific loading may be programmable and controlled from the control system 60 through the user interface 61. The purpose of the loading is to simulate hand pressure and take out minimal amounts of warp from the metal beam to provide a more reliable displacement reading both during and after bending.

The locking clamp 46 may also include several springs 46-15 placed between the supports (e.g., support structure 46-12) and shoes (e.g., shoe 46-2) described herein in order to provide an opposing force for the shoe assemblies blocks to return them to their open configuration after an actuator is retracted.

Regarding the actuators of second locking clamp 46 (i.e., actuators 46-8, 46-9, 46-10, and 46-11), each actuator may be in fluid communication with the supply cylinder 48 through one or more tubes that connect with the supply cylinder 48 through pivot point 45-4 and any intervening support structures (e.g., support structure 46-12).

As shown in FIGS. 2 and 3, the apparatus 1 may include a metal beam cradle 51 having a metal beam feed mechanism 52, retractable metal beam supports 53, a metal beam advancing member 54 connected to feed mechanism 52, and an advancing take up actuator 55 connected to the advancing member 54. The apparatus 1 may also include a sensor, such as a laser sensor, that measures the length of the metal beam to be advanced into the fixed clamp member 30 and bending clamp member 40.

The metal beam cradle 51 may include a track upon which the advancing member 54 may be placed. The feed mechanism 52 may include an electric motor having a belt or cable connected to the advancing member 54 such that the advancing member may be moved along the metal beam cradle 51 by operation of the feed mechanism. A metal beam 50 to be fed into the fixed clamp member 30 and bending clamp member 40 by the metal beam cradle 51 at its proximal end may have a distal end that is connected to the advancing member 54. Additionally, the metal beam 50 may be placed in the retractable metal beam supports 53. The feed mechanism may be connected (either wirelessly or through a wired connection) to the control system 60.

Upon activation of the feed mechanism 52, the metal beam 50 may be advanced along the metal beam cradle 51 by moving the advancing member 54. Furthermore, as the advancing member 54 proceeds along the track of the metal beam cradle 51, the retractable beam supports 53 (which include an actuator and switch) may be retracted by the advancing take up actuator 55 which uses a retractable wheel, connected to a pneumatic actuator, to contact a switch on each of the retractable metal beam supports 53. By retracting the metal beam supports 53, the apparatus 1 prevents a collision between the supports 53 and the advancing member 54. In certain embodiments of the invention, retractable beam support spacing (i.e., the distance between each retractable beam support 53) may be, for example, about 5 to 25 inches.

The apparatus 1 may further include a control system 60 that is provided to monitor the various components of the apparatus, provide commands or instructions to the various components of the apparatus, and record data associated with the bending processes of the apparatus 1. The control system 60 may be connected to and/or communicate with one or more of the components of the apparatus including, for example, the fixed clamp member 30, the bending clamp member 40, the metal beam cradle 51, the actuator supply unit 70, and the part scanner 80. Additionally, the control system 60 may further communicate with a remote server 100.

The terms "communicate," "communication," and "communicatively coupled" are defined herein, unless more specifically indicated (e.g, fluidic communication, mechanical communication), as a general state in which two or more components of the system 1 (e.g., and actuator of the fixed clamp member 30 and the control system 60) are connected such that communication signals are able to be exchanged (directly or indirectly) between the components on a unidirectional or bidirectional (or multi-directional) manner, either wirelessly, through a wired connection, or a combination of both as would be understood by a person having ordinary skill in the art. As shown in FIG. 2, certain components of the apparatus 1 (e.g., the control system 60, remote server 100) may communicate with other components of the apparatus 1 through electrical connections 120, which may be wired or wireless lines of communication, as would be understood by a person having ordinary skill in the art.

The control system 60 may include a processor, one or more transceivers or ports for communicating with connected components and sensors, and a user interface 61. The term "processor" as used herein is a broad term and, unless more specifically indicated, is to be given its ordinary and customary meaning to a person of ordinary skill in the art, and furthermore refers without limitation to a computer system, state machine, and the like that performs arithmetic and logic operations using logic circuitry that respond to and process the basic instructions that drive a computer. The control system 60 of the invention may also include data storage devices that include non-transitory media, such as floppy disks and diskettes, compact disk (CD)-ROMs (whether or not writeable), DVD digital disks, RAM and ROM memories, computer hard drives and back-up drives, external hard drives, "thumb" drives, and any other storage medium readable by a computer for the storage of electronic data, in any form, as described herein.

The user interface 61 of control system 60 may include at least one of textual, graphical, audio, video, animation, and/or haptic elements. A textual element may be provided, for example, by a printer, monitor, display, projector, etc. A graphical element may be provided, for example, through a monitor, display, projector, and/or visual indication device, such as a light, flag, beacon, etc. An audio element may be provided, for example, through a speaker, microphone, and/or other sound generating and/or receiving device. A video element or animation element may be provided, for example, through a monitor, display, projector, and/or other visual device. A haptic element may be provided, for example, via a very low frequency speaker, vibrator, tactile stimulator, tactile pad, simulator, keyboard, keypad, mouse, trackball, joystick, game pad, wheel, touch pad, touch panel, pointing device, and/or other haptic device, etc.

The user interface 61 may include a part scanner (e.g., a wand, bar code reader, and the like) that may be used to scan a code associated with a metal beam 50 to be subject to a bending operation and download or otherwise retrieve metal beam related information from a look up table stored at the control system 60 or on a remote server 100. For example, the metal beam related information may include part parameters, bending instructions, or other requirements necessary to provide a bending operation on a specific metal beam. Accordingly, in certain embodiments of the invention, the apparatus 1 may incorporate a bar code reader or scanner that is used to read the part number and work order number into the control software.

Referring to the control system 60 more broadly, control of the system may be performed by the control system 60 with the user interface 61. The user interface 61 may display all operating conditions including ram or mechanical forming element displacement or location, part displacement (including if the part is not initially straight before forming), the required amount of deflection being formed, the difference between required deflection and what is currently in the part, the load being applied by the ram (in psi or lbf), and the status of the pumps, valves, safety systems, inspection systems, critical operating components, alarm conditions, and the current mode of operation (e.g., manual or automatic). The control system 60 may also be programmed to monitor and record apparatus and part operating parameters and alarm conditions and keep historical records of machine runs by part number and work order, for example. All data generated by the apparatus 1, and recorded at the control system 60, may be transferred to a remote server 100 having a remote user interface 110.

The control system 60 may be programmed to execute part number specific programs for a forming cycle. Operation of apparatus 1 may be conducted using the user interface 61 with a program download function and serial interface with an additional computer, such as a laptop. All apparatus operations may be conducted at the user interface 61.

When part numbers are scanned in at the user interface 61, the apparatus 1 may automatically configure itself to the part number that may be scanned in (e.g., wanded in), and may notify an operator if the part number is invalid or a part program does not exist. The control system 60 may also allow the part number and work order number to be entered manually at the user interface 61, or selected at the user interface 61 from a table or menu of available part numbers. A user may upload a new part number, and associated program at the user interface 61.

For example, when a part number is entered into the control system 61, the user interface 61 may display part specific information to aid a user when loading the metal beam into the device. The part specific information may include, for instance, pictorial representations to assist a user in identifying that the correct end of the metal beam is loaded in to the device, or it may be other part specific information that is important to the correct operation of the machine, such as operations instructions.

Control of the apparatus 1 may be accomplished by monitoring and adjusting the mechanical forming elements (e.g., bending clamp member 40 and fixed clamp member 30) according to the readings of an inspection system that measures part displacement in the device and compares the readings to the required displacement for the given part number at the location indicated.

The control system 60 may control the components of the apparatus 1 to produce the required bends in the metal beams, with incremental feedback for adjusting the fixed clamp member 30 and the bending clamp member 40 to compensate for differences in metal beam spring back or incoming part flatness that require additional bends or "hits" to achieve the desired forming tolerance. The control system 60 may be able to correct overform conditions when too much contour has been formed into a part. The control system 60 may then display actual part displacement relative to the required displacement at the user interface 61 to guide the user. In certain embodiments, the actuators of the invention may be prepared to provide a force of up to about 1 to 50 tons, as needed, to bend the metal beams or other materials by the apparatus and methods of the invention. For example, the actuators of the invention (e.g., actuators 42 and 43) may provide a bending force of about 12,000 pounds (i.e., about 6 tons).

The control system 61 may be configured to operate the components of the apparatus 1 (e.g., fixed clamp member 30, bending clamp member 40, and metal beam cradle 51) in either automatic mode or manual mode.

In manual mode, all apparatus components are controlled by user input at the user interface 61. The control system 60 allows for fully manual operation of all controls upon demand.

When a part program or spring back model exists for the metal beam being formed, and the manual mode is selected, the control software at the control system 60 may display on-screen prompts at the user interface 61 for what the apparatus settings should be at the fixed clamp member 30 and bending clamp member 40 to achieve the desired amount of form in the metal beam 50 to achieve a certain contour. The on-screen prompts at the user interface 61 may be based on pre-programmed values for the metal beam being formed.

In the automatic mode, all apparatus components of the invention are controlled by a program that is tied to a specific part number for a metal beam 50. In the event that the part displacement is not achieved by the programmed setting, the user may be given the option to let the system incrementally form the piece to the desired tolerance using a saved adjustment routine, or override the incremental adjustment routine with specific user defined manual inputs.

The control system 60 may have logic to permit decisions to be made, such as adjusting the forming element displacement when part displacement readings fall outside of specified limits or an overform condition occurs.

The control system 60 may generate alarms when predetermined conditions are met, such as the hydraulic fluid is over or under a predetermined operating temperature, hydraulic level is low, a travel limiter has been tripped, an over pressure has occurred, a safety feature has been activated, or a system fault has occurred. The alarm conditions may be identified by a text message at the user interface 61 and stored in an alarms log, along with the date and time of occurrence. Alarm messages may be written in a form that is easy for the user to understand without having to refer to a manual or error register.

A user interface 61 at the control system 60 may be used to record the part number, part work order number, part inspection records, alarm conditions, date, time, and other essential operating parameters. Historical data generated by device runs shall be collected and stored. The control system 60 shall automatically assign data files to the work order number of the metal beam for later retrieval.

The control system 60 may be programmed to generate text reports on each part by specific work order numbers. The control system 60 may also be programmed to provide a contour inspection report for each individual work order number that describes the displacement requirement at each station formed, the actual metal beam displacement at that location, the difference between required and actual, and a PASS/FAIL assessment based on the forming tolerance. The inspection report may list the part number, work order number, date, time, and forming routine used, along with other pertinent information. The control system 60 may be programmed to generate a text report of alarm conditions experienced by the device that detail the specific alarm, the component or member that generated the alarm, and the data and time of the alarm.

Part specific programming may be accomplished from a laptop or portable computer (PC) connected to the user interface 61 at the control system 60; or by using a remote server 100 connected via the Internet to the control system 60.

Furthermore, the control system 60 may be programmed to generate a calibration report upon demand for records keeping. The report may include the date, time, and readings from each of the measuring devices relative to the measurement standard. The report may indicate PASS or FAIL based upon the difference between the standard and actual reading against a pre-defined tolerance. The report may be electronically stored as part of the calibration records. The report may reference governing specifications or standards for the calibration. For example, when applying a bend, a passing displacement may have a pre-defined tolerance of about +/−0.020 inches. Thus, in certain embodiments, a passing displacement at a bend may be defined as being a displacement that is within 0.020 inches of a predetermined displacement for a given bend location along a metal beam.

The apparatus 1 may include an actuator supply unit 70, which may be a reservoir and/or pumping system to provide a positive pressure source for the actuators described herein. Indeed, each actuator described herein, unless more specifically defined (i.e., the actuators of second locking clamp 46), may have one or more hoses connected to the actuator supply unit 70. Moreover, the actuator supply unit 70 may be connected to or in communication with control system 60. The control system 60 may monitor the operability of the actuator supply unit 70 and provide commands or instructions to the actuator supply unit 70 as necessary to operate the actuators described herein. In certain embodiments, the actuator supply unit 70 may include a pneumatic pressure source or reservoir, a hydraulic pressure source or reservoir, or a combination thereof. Preferably, the actuator supply unit 70 includes a pneumatic-hydraulic pressure source and reservoir (e.g., an air over oil pressure source).

The apparatus 1 may further include a contour inspection system 80. The contour inspection system 80 may be connected to the platform 10 and may receive the metal beam 50 after it exits from the bending clamp member 40. The contour inspection system 80 may include one or more sensors that measure the contour of the formed metal beam as it exits the bending clamp member 40. Alternatively, the contour inspection system 80 may be located proximate to the bending clamp member 40 and may include at least one sensor that measures the displacement of the metal bream after the bending clamp member 40 releases the metal beam 50 and returns to a neutral position. If, after the bending clamp member 40 returns to a neutral position, the contour inspection system 80 finds that the bend and/or contour is within pre-defined tolerances (e.g., about +/−0.020 inches) the metal beam 50 may be advanced to the next bend location. For example, the sensors may include one or more followers or lasers that map and/or measure the contour of the formed metal beam. The sensors at the contour inspection system may be transmitted in real time to the control system 60 to allow a user to monitor the forming process or prepare a report. The purpose of the contour inspection system 80 is to eliminate the need for contour check templates that require removal of the part from the apparatus 1. At the conclusion of the forming operation, the invention may include the preparation of a machine generated inspection report by the control system 60 that verifies compliance to a contour requirement.

Furthermore, the apparatus 1 may include one or more sensors (e.g., followers) that may measure and record the amount of travel of the part into the machine for positive location, the initial part displacement, the amount of travel or displacement of the mechanical forming elements, the location of the machine elements that support or clamp the work piece, and the resulting part displacement following bending. These measurements may be recorded at the control system 60 and displayed at the user interface 61. Travel of the metal beam 50 may be limited by the control system 60 to prevent part overload and damage. The travel limits may be predetermined in a technique sheet that applies to a specific forming operation.

Based on the foregoing, the apparatus 1 may provide a variety of additional features. For example, the apparatus 1 may control, prevent, or correct out of plane deformations in the flanges or web of the metal beams being formed by using the bending clamp member 40. The apparatus 1 may also maintain the angle between the flanges and web of the part being formed through the use of fixed clamp member 30 and bending clamp member 40.

The apparatus 1 may also control, prevent, or correct overform, where too much displacement is formed into a metal beam and the part must be formed in the reverse direction to achieve the desired contour tolerance. The apparatus of the invention may impart positive and negative curvature for contour reversals or perform contour corrections for overform conditions with the bending clamp member 40. In other aspects, the apparatus 1 may compensate for warped material, where the warp may be removed with minimal loading (e.g., 10 lbs) that represents hand pressure on the material.

The apparatus 1 may also include a metal beam support 90 that cradles or supports the metal beam 50 after it exits the bending clamp member 40 and/or the contour inspection system 80. The metal beam support 90 may be a tray or table. Securing the output of the apparatus 1 may become important during the forming process to prevent injury or damage to the metal beam as the metal beam is advanced through the apparatus 1. When a forming load is applied to a part or metal beam, the free ends of the part may react by flexing in the opposite direction of the loading. For example, if a downward load is applied vertically to the part, the free ends will spring vertically upward. If the load is applied horizontally to the part, the free ends will likewise flex horizontally in a direction that is opposite to the loading. As described herein, the forming components of the apparatus 1 may be designed to control or compensate for the free end reactions to the forming load to prevent the part from being damaged or to protect an operator or bystanders. In addition, the metal beam cradle 51 and the metal beam support 90 may combine to support the total length of the part throughout the forming of the part in the apparatus 1 at all times. Accordingly, the apparatus 1 includes components that may support the metal beam 50 before, during, and/or after the forming process to prevent damage to the metal beam and prevent injury to bystanders.

Additionally, the apparatus 1 may include a power source (e.g., an AC power source) for powering the various components therein.

The present invention also includes a method of bending a metal beam that has a shear center and at least one principal axis with a bending apparatus (e.g., apparatus 1) to produce a deflected metal beam. In preferred aspects, the bending apparatus has a fixed clamp member (i.e., fixed clamp member 30) and bending clamp member (i.e., bending clamp member 40), as described herein.

Broadly, the method of the invention may include the steps of inserting a metal beam into the fixed clamp member and the bending clamp member and clamping a first portion of the metal beam in the fixed clamp member and clamping a second portion of the metal beam in the bending clamp member. The methods of the invention may further include bending the metal beam through its shear center and along at least one principal axis by: (1) applying a first bending force to the metal beam with a first bend actuator; (2) detecting twisting of the metal beam and, if twisting is detected, modulating the angle at which the first bending force is applied with a linkage assembly until no twisting is detected; and (3) applying a second bending force to the metal beam with a second bend actuator, wherein the first bending force and the second bending force combine to bend the metal beam along the at least one principal axis. For example, the first bending force may be applied with a force of about 2,000 to 8,000 pounds and the second bending force may be applied with a force of about 2,000 to 8,000 pounds, where the first and second bending forces are applied in about a 2:1 ratio, respectively. Finally, the methods of the invention may include receiving the deflected metal beam from the apparatus of the invention.

Figure 8:
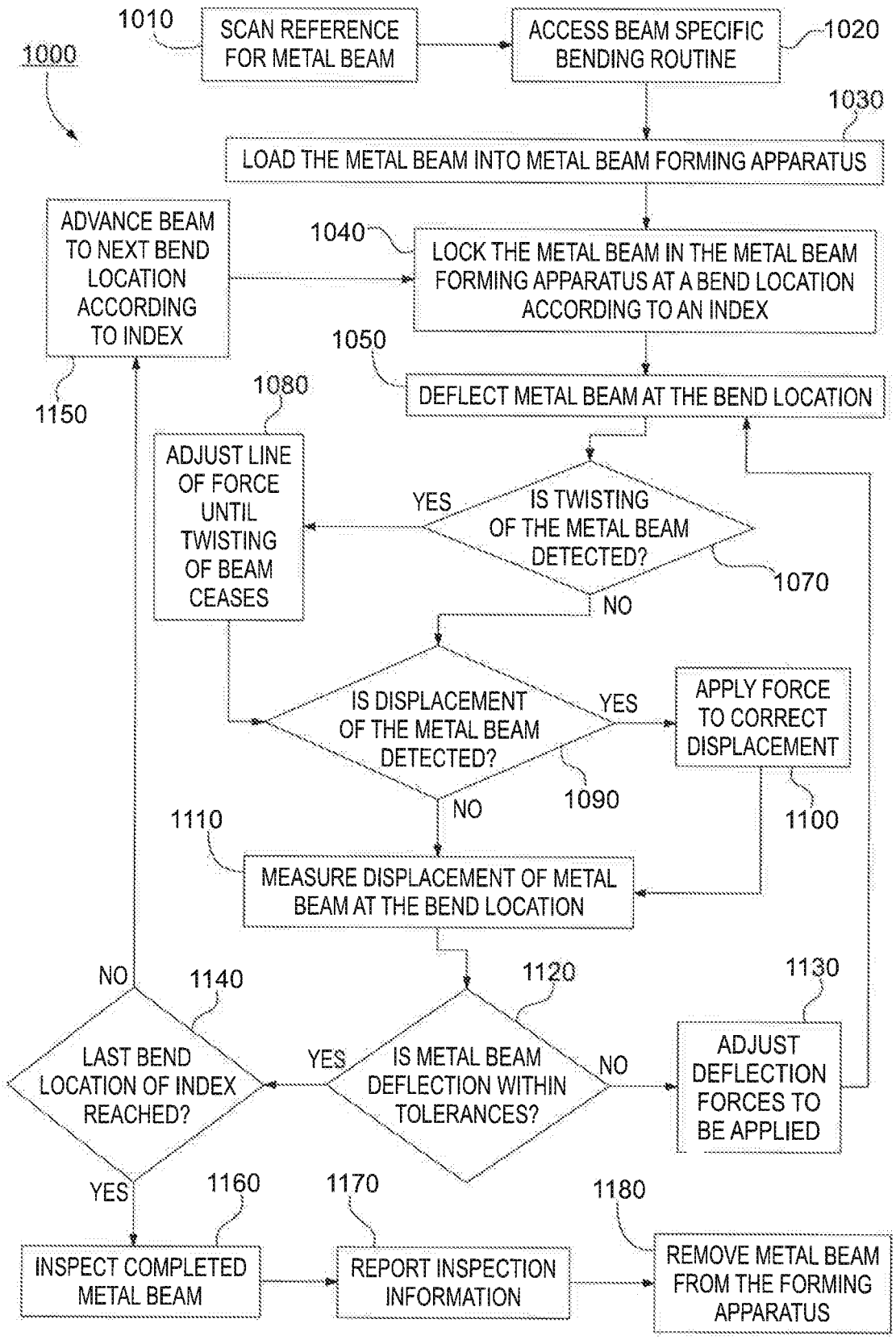
FIG. 8 diagrammatically illustrates an exemplary method for forming metal beams with an apparatus of the invention.

The present invention provides a bending method 1000 in FIG. 8. In a first step of the method 1000, a user of the apparatus 1 may scan a reference for a metal beam to be deflected (step 1010). Upon scanning the metal beam reference, the user may access and receive at a user interface the bending routine and bending instructions for the metal beam (step 1020). The bending routine and instructions may include either a bending program for an automated process or a list of bends, and where such bends should occur on the metal beam, for a manual bending process. Both the automated process and the manual process will include an index that defines where all the deflections should occur on the metal beam with associated magnitudes of the deflections to provide a specific contour for the metal beam.

After processing the bending routine and bending instructions for the metal beam, the user may load the metal beam into the metal beam forming device (i.e., apparatus 1) (step 1030). Loading the metal beam may include ensuring that a first bending location is aligned with the bending clamp and fixed clamp of the apparatus 1.

The metal beams formed by the methods of the invention may be symmetrical or unsymmetrical. However, various metal beams may be formed by methods of the invention including, but not limited to, metal beams having an I shaped cross-section, a Z-shaped cross-section, a J-shaped cross-section, a T-shaped cross-section, an L-shaped cross-section, a U-shaped cross-section, or a combination thereof. In certain embodiments of the invention, the metal beams formed by the methods of the invention are Z-shaped metal beams. In addition, the metal beams of the invention may be aircraft stringers.

The methods of the invention may be used to form any beam, for example metal beam, which includes a metal alloy or any other material that exhibits plastic deformation where the other material is loaded above its proportional limit. The proportional limit may be defined as the maximum stress for which the stress remains proportional to strain and permanent deformation may begin to occur. For example, the metal alloys of the invention (e.g., those alloys used in a metal beam) may be selected from the group consisting of an aluminum alloy, a titanium alloy, a magnesium alloy, a steel alloy, and a combination thereof.

Upon loading the metal beam, the metal beam is locked at a first portion and second portion in the forming device at a bend location that is provided according to the index (step 1040). The user may then confirm that the metal beam is locked to ensure that the bend may occur at the correct bend location.

After locking, the metal beam may be deflected at the bend location by applying a first bending force to the metal beam (e.g., a horizontal bending force) with a first bend actuator (step 1050). During the application of the first bending force, a sensor is used to determine if any twisting in the metal beam is detected due to the first bending force not being applied through the shear center of the metal beam (step 1070).

If twisting of the metal beam is detected, the line of force is adjusted by varying the angle at which the first bending force is applied to the metal beam (step 1080). The line of force is adjusted until twisting of the metal beam stops. When the twisting stops, the angle of the line of force is maintained and it is presumed that the line of force from the first bending force is in a plane that passes through the shear center of the metal beam.

The method then includes a determination of whether out of plane displacement of the metal beam has occurred during the bending process (step 1090). If out of plane bending has occurred or is occurring, a second bending force is applied in a direction substantially perpendicular to the first bending force to correct the displacement of the metal beam (step 1100). However, as a person having ordinary skill in the art may appreciate, the first and second bending forces need not be substantially perpendicular provided that they combine to yield a line of force along a principal axis of the metal beam. Indeed, in preferred embodiments of the invention the first bending force and the second bending force combine to provide a line of force along a principal axis of the metal beam. Moreover, the first bending force and second bending force may be provided in a ratio of about 2:1, respectively.

After deflection of the metal beam, and providing any corrections to adjust for twisting of the metal beam (step 1080) or out of plane bending (step 1100), the bending components of the apparatus 1 are returned to their neutral position and the deflection of the metal beam may be measured to determine if the bend required for the bend location matches the measured magnitude of displacement (step 1120). For example, the forming tolerance may be about +/−0.020 inches for each bend or deflection.

If the metal beam deflections are not within predetermined tolerances, the apparatus 1 is then activated to again deflect the beam at the bend location (step 1050). If the metal beam deflections are within predetermined tolerances, the apparatus 1 (automatic mode) or the user (manual mode) determines if the last bend location has been reached according to the bend index for the specific metal beam (step 1140). If the last bend location has not been reached, the metal beam is unlocked from the fixed clamp and bending clamp of the apparatus 1 and the metal beam is advanced through the apparatus 1 to the next bend location according to the bend index (step 1150). The next bend location is then located at the fixed clamp member and the bending clamp member and the metal beam is then locked as described above at step 1040. Steps 1050 to 1120 are then repeated for the next bend location to shape the metal beam to the appropriate contour.

However, if the last bend location has been reached according to step 1140, the completed metal beam is inspected by either the user with a contour template or the metal beam is inspected automatically with a contour inspection system of the apparatus 1 (step 1160).

Upon completion of the inspection, the control system of the apparatus 1 may prepare an inspection report that may be displayed at the user interface of the control system (step 1170).

After completion of the inspection report, the deflected metal beam may be removed from the forming apparatus 1 (step 1180). The apparatus 1 may then be reset to receive the next metal beam.

Regarding the deflection steps of the methods of the invention, and related apparatus components, the present invention provides automatic forming to achieve a desired metal beam contour. The desired contour for a formed metal beam may be provided using a look up table (i.e., a bending table or index that lists the preferred displacement at a plurality of bend locations along a metal beam) or may be prepared during forming with the control system 60 based on a three-dimensional model of a curved metal beam having the desired contour. Indeed, the control system 60 may be programmed to receive the three-dimensional model of the curved metal beam having the desired contour and may map out the bend locations along the metal beam to provide the desired contour.

A spring back model may be used in accordance with the invention to compensate for multiple hits and the hysteresis as described by a material stress strain diagram when plasticity occurs during repeated loading and unloading. The spring back model may be developed with the use of material simulations including, for example, finite element modeling, material modeling, or other material simulation methods known in the art. When deflecting or bending metal beams, the apparatus and methods of the invention may account for the spring back of the metal beams by providing an overform deflection as set forth in a pre-determined look up table. Alternatively, the overform deflection may be applied with the aid of a spring back model as described herein.

Spring back of a particular metal beam is affected by alloy and temper, cross-section, heat lot variations, and warp. In preferred methods of the invention, all of the metal beams will be of the same alloy and temper. However, certain metal beams formed by the methods and apparatus of the invention may have varied cross-sections. For example, when forming aircraft stringers, the cross-sections may vary along the length of the metal beam, as part height tapers from inboard to outboard end and part thickness changes. There may also be variations in heat lot and warp from part to part of the same part number.

The machine control system of the invention may be programmed to self-adjust or compensate when the spring back specific data does not produce the desired result. There are a number of methods to accomplish this self-adjustment feature. One is to monitor the running error between the applied deflection and the resulting part deflection and factor that error compensation into subsequent applied deflections. Another method is to "creep" up onto the required deflection in the part with multiple bends or "hits." However, the number of hits allowed, for certain methods of the present invention, may be limited depending upon the specification for a metal beam. For example, limitations may include providing only three hits in one direction at any single location on the part plus one reverse hit for correcting overform. The metal beam may be indexed by 1-inch inboard or outboard to allow additional hits to bring a particular station into contour tolerance.

In certain embodiments of the invention, a spring back model may be used to develop system settings. The spring back model may encompass processing material specific data like stress strain curve data, computer simulation data, finite element model data, or data developed from simple bending tests.

The apparatus and methods of the invention may also include forming metal beams at elevated temperatures. For example, apparatus 1 may include a heater configured to heat the metal beam before bending. In addition, the methods of the invention may include receiving a heated metal beam before loading the metal beam into the forming apparatus at step 1030 of the method 1000.

One exemplary use of the methods of the invention is for forming aircraft stringers, such as aluminum wing stringers, at room temperature. Indeed, the apparatus of the invention may mechanically form aircraft stringers that are less than about 60 feet in length, with structure on either side of the forming elements to support the pieces being formed as they are advanced through the device.

For certain aircraft, there are 44 stringers of 4 different configurations that require forming per wing, see FIG. 9. There are right and left hand variants of each part, which are not necessarily symmetrical, making a total of 88 parts to be formed per aircraft. The most common configuration is the Z cross-sectioned stringer. There are also vent stringers of a channel or hat shape, splice stringers of a "J" shape, and coaming stringers, which are a Z with a wider attachment flange. Preferably, the device and methods of the invention may be used to form Z stringers because the upper and lower Z stringers make up 82 out of 88 stringers on the aircraft.

All stringer dimensions are subject to change from the inboard end of the part to the outboard end. The formed shapes vary of from a simple bow or "U" shape, with all the deflection in one direction, to "U" shapes with reversals, to "S" shapes with multiple contour reversals.

In aircraft forming applications, the apparatus of the invention may form permanent deformations in wing stringers that are machined from aluminum lithium alloy 2099-T83, but may also be adapted to form other aluminum alloys including those in the 2000, 6000, and 7000 series, such as alloys 2024, 2124, 2324, 7075, 7449, and 7055.

The present methods of the invention can be embodied as a computer implemented process or processes and/or apparatus for performing such computer-implemented process or processes, and can also be embodied in the form of a tangible storage medium containing a computer program or other machine-readable instructions (herein "computer program"), wherein when the computer program is loaded into a computer or other processor (herein "computer") and/or is executed by the computer, the computer becomes an apparatus for practicing the process or processes. Storage media for containing such computer programs include, for example, floppy disks and diskettes, compact disk (CD)-ROMs (whether or not writeable), DVD digital disks, RAM and ROM memories, computer hard drives and back-up drives, external hard drives, "thumb" drives, and any other storage medium readable by a computer. The process or processes can also be embodied in the form of a computer program, for example, whether stored in a storage medium or transmitted over a transmission medium such as electrical conductors, fiber optics or other light conductors, or by electromagnetic radiation, wherein when the computer program is loaded into a computer and/or is executed by the computer, the computer becomes an apparatus for practicing the process or processes. The process or processes may be implemented on a general purpose microprocessor or on a digital processor specifically configured to practice the process or processes. When a general-purpose microprocessor is employed, the computer program code configures the circuitry of the microprocessor to create specific logic circuit arrangements. Storage medium readable by a computer includes medium being readable by a computer per se or by another machine that reads the computer instructions for providing those instructions to a computer for controlling its operation. Such machines may include, for example, a punched card reader, a magnetic tape reader, a magnetic card reader, a memory card reader, an optical scanner, as well as machines for reading the storage media mentioned above.

It is noted that various sensor values and alarm values produced by the sensors or control system of the invention may represent actual physical conditions of different places and/or different equipment and/or different parts of the apparatus or other place, e.g., generally local conditions, that are transformed by the apparatus and methods described herein to provide a representation of the overall state and/or condition of the apparatus, a beam being bent, or place, e.g., a representation of a status at the sensor. That representation may be transformative of a representation of a nominal overall state and/or condition thereof, e.g., in a prior or different condition and/or time, to a representation of an actual overall state and/or condition thereof, e.g., in a present or more recent or otherwise different condition and/or time. In accordance with the foregoing, the apparatus described herein may include one or more general purpose and/or special purpose computers, or microprocessors or other processors, and the methods described herein may be performed in part by one or more general purpose and/or special purpose computers, or microprocessors or other processors.

A number of patent and non-patent publications may be cited herein in order to describe the state of the art to which this invention pertains. The entire disclosure of each of these publications is incorporated by reference herein.

While certain embodiments of the present invention have been described and/or exemplified above, various other embodiments will be apparent to those skilled in the art from the foregoing disclosure. The present invention is, therefore, not limited to the particular embodiments described and/or exemplified, but is capable of considerable variation and modification without departure from the scope and spirit of the appended claims.

Moreover, as used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Furthermore, the transitional terms "comprising", "consisting essentially of" and "consisting of", when used in the appended claims, in original and amended form, define the claim scope with respect to what unrecited additional claim elements or steps, if any, are excluded from the scope of the claim(s). The term "comprising" is intended to be inclusive or open-ended and does not exclude any additional, unrecited element, method, step or material. The term "consisting of" excludes any element, step or material other than those specified in the claim and, in the latter instance, impurities ordinary associated with the specified material(s). The term "consisting essentially of" limits the scope of a claim to the specified elements, steps or material(s) and those that do not materially affect the basic and novel characteristic(s) of the claimed invention. All apparatuses and methods described herein that embody the present invention can, in alternate embodiments, be more specifically defined by any of the transitional terms "comprising," "consisting essentially of," and "consisting of."

What is claimed is:

1. A method of bending a metal beam having a shear center and at least one principal axis to provide a deflected metal beam, the method comprising: (a) clamping a first portion of the metal beam in a substantially fixed position; (b) clamping a second portion of the metal beam in a position where at the metal beam is rotatable about three axes in reaction to a bending force applied thereat; (c) applying a first bending force to the clamped second portion of the metal beam in a first direction by an actuator; (d) applying a second bending force to the clamped second portion of the metal beam in a second direction that is substantially perpendicular to the first bending force by an actuator, wherein the first and second bending forces produce a net bending force; (e) sensing twisting of the second portion of the metal beam resulting from applying the first and second bending forces by a laser sensor; and (f) translating the first bending force in a direction that is transverse to the first direction and that reduces the twisting of the metal beam, whereby the net bending force is moved toward the shear center and toward being along the principal axis of the metal beam, wherein step (c) includes applying the first bending force to the clamped second portion of the metal beam in a horizontal direction; step (d) includes applying the second bending force to the clamped second portion of the metal beam in a vertical direction; and step (f) includes translating the first bending force in a vertical direction that reduces the twisting of the metal beam.

2. The method for forming a metal beam of claim 1 wherein the translating the first bending force in a direction that is transverse to the first direction and that reduces the twisting of the metal beam moves the net bending force to be substantially through the shear center and to be substantially along the principal axis of the metal beam.

3. The method for forming a metal beam of claim 1 further comprising: removing the first and second bending forces to unload the metal beam; while the metal beam is unloaded, measuring deflection of the metal beam resulting from the applying the first and second bending forces; determining, from the measured deflection of the metal beam, values for the first and second bending forces; applying the first and second bending forces at the determined values thereof; sensing twisting of the second portion of the metal beam resulting from applying the first and second bending forces at the determined values thereof; and translating the first bending force at the determined value thereof in a direction that is transverse to the first direction and that reduces the twisting of the metal beam.

4. The method for forming a metal beam of claim 1 wherein the translating the first bending force in a direction that is transverse to the first direction modulates the angle at which the net bending force is applied to the metal beam.

5. The method for forming a metal beam of claim 1 wherein the sensing twisting of the second portion of the metal beam resulting from applying the first and second bending forces; and the translating the first bending force locates the shear center of the cross section of the metal beam and applies the net bending force through the shear center, whereby twisting of the metal beam is substantially reduced during forming the metal beam.

6. The method for forming a metal beam of claim 1 further comprising: unclamping the first and second portions of the metal beam; advancing the metal beam to an advanced position; and repeating steps (a) through (f) with the metal beam in the advanced position.

7. The method for forming a metal beam of claim 1 further comprising inputting bending instructions for the metal beam that identify the first and second bending forces to be applied to the metal beam and deflection of the metal beam at plural locations along the metal beam.

8. The method for forming a metal beam of claim 7 wherein the inputting bending instructions includes: inputting a part number of the metal beam and receiving bending instructions for the metal beam; or inputting a part number of the metal beam and receiving bending instructions for the metal beam from a look-up table relative to the part number.

9. The method for forming a metal beam of claim 7 wherein the plural locations are identified by an index, the method further comprising: unclamping the first and second portions of the metal beam; advancing the metal beam to an advanced position in accordance with the index; and repeating steps (a) through (f) with the metal beam in the advanced position.

10. The method for forming a metal beam of claim 1 further comprising: measuring displacement of the metal beam after the applying of the first and second bending forces; determining whether the displacement is within a predetermined tolerance; when the displacement is not within the predetermined tolerance, then adjusting the first and second bending forces; and applying the adjusted first and second bending forces.

11. The method for forming a metal beam of claim 1 wherein the substantially fixed position recited in step (a) in which the metal beam is clamped includes compliance in the fixed position to allow the metal beam one degree of freedom.

12. The method of claim 1 further comprising inputting a part number of the metal beam and receiving bending instructions for the metal beam from a look-up table relative to the part number.

13. The method of claim 1 comprising measuring the deflection of the deflected metal beam, and, if the deflection is not within a predetermined deflection tolerance, then repeating bending the metal beam through its shear center and along at least one principal axis.

14. The method of claim 13 wherein measuring the deflection of the deflected metal beam comprises at least one of: determining whether the deflection is within a predetermined deflection tolerance; and determining whether additional bending is required to provide a predetermined degree of deflection.

15. The method of claim 1 further comprising advancing the metal beam and repeating steps (b) and (c).

16. The method of claim 1 comprising detecting out of plane bending of the metal beam.

17. The method of claim 1 wherein the metal beam comprises a cross-section selected from the group consisting of an I-shaped cross-section, a Z-shaped cross-section, a J-shaped cross-section, a T-shaped cross-section, an L-shaped cross-section, a U-shaped cross-section, and a combination thereof.

18. The method of claim 1, wherein the metal beam comprises an aircraft stringer or comprises an aluminum aircraft stringer.

19. The method of claim 1, wherein the metal beam comprises an aluminum alloy, a steel alloy, a magnesium alloy, a titanium alloy, or a combination thereof.

20. The method of claim 1, wherein steps (c)(i), (c)(ii), and (c)(iii) are performed sequentially or wherein steps (c)(i), (c)(ii), and (c)(iii) are performed simultaneously.

21. A method of bending a metal beam having a shear center and at least one principal axis to provide a deflected metal beam, the method comprising: (a) clamping a first portion of the metal beam in a substantially fixed position; (b) clamping a second portion of the metal beam in a position whereat the metal beam is rotatable about three axes in reaction to a bending force applied thereat; (c) applying a net bending force to the clamped second portion of the metal beam at a predetermined angle by an actuator; (d) sensing twisting of the second portion of the metal beam resulting from applying the net bending force by a laser sensor; and (e) modulating the angle at which the net force is applied in a direction that reduces the twisting of the metal beam, whereby the net bending force is moved toward the shear center and toward being along the principal axis of the metal beam, wherein the applying a the net bending force to the clamped second portion of the metal beam includes applying a first bending force in a first direction and applying a second bending force in a direction that is substantially perpendicular to the first direction of the first bending force, and wherein the sensing twisting and the modulating the angle at which the net bending force is applied to the metal beam includes: sensing twisting of the second portion of the metal beam resulting from applying the first and second bending forces; and translating the first bending force in a direction that is transverse to the first direction and that reduces the twisting of the metal beam, wherein the first bending force is applied to the clamped second portion of the metal beam in a horizontal direction; the second bending force is applied to the clamped second portion of the metal beam in a vertical direction; and the first bending force is translated in a vertical direction that reduces the twisting of the metal beam.

22. The method for forming a metal beam of claim 21 wherein the modulating the angle of the net bending force in a direction that reduces the twisting of the metal beam moves the net bending force to be substantially through the shear center and to be substantially along the principal axis of the metal beam.

23. The method for forming a metal beam of claim 21 further comprising: removing the net bending force to unload the metal beam; while the metal beam is unloaded, measuring deflection of the metal beam resulting from the applying the net bending force; determining from the measured deflection of the metal beam a value for the net bending force; applying the net bending force at the determined value thereof; sensing twisting of the second portion of the metal beam resulting from applying the net bending force at the determined value thereof; and modulating the angle of the net bending force at the determined value thereof in a direction that reduces the twisting of the metal beam.

24. The method for forming a metal beam of claim 21 wherein the sensing twisting of the second portion of the metal beam resulting from applying the net bending force; and the modulating the angle of the net bending force locates the shear center of the cross section of the metal beam and applies the net bending force through the shear center, whereby twisting of the metal beam is substantially reduced during forming the metal beam.

25. The method for forming a metal beam of claim 21 further comprising: unclamping the first and second portions of the metal beam; advancing the metal beam to an advanced position; and repeating steps (a) through (f) with the metal beam in the advanced position.

26. The method for forming a metal beam of claim 21 further comprising inputting bending instructions for the metal beam that identify the net bending force to be applied to the metal beam and the angle thereof, and deflection of the metal beam at plural locations along the metal beam.

27. The method for forming a metal beam of claim 26 wherein the inputting bending instructions includes: inputting a part number of the metal beam and receiving bending instructions for the metal beam; or inputting a part number of the metal beam and receiving bending instructions for the metal beam from a look-up table relative to the part number.

28. The method for forming a metal beam of claim 26 wherein the plural locations are identified by an index, the method further comprising: unclamping the first and second portions of the metal beam; advancing the metal beam to an advanced position in accordance with the index; and repeating steps (a) through (f) with the metal beam in the advanced position.

29. The method for forming a metal beam of claim 21 further comprising: measuring displacement of the metal beam after the applying of the net bending force; determining whether the displacement is within a predetermined tolerance; when the displacement is not within the predetermined tolerance, then adjusting the net bending force and/or the angle thereof; and applying the adjusted net bending force at the adjusted angle thereof.

30. The method for forming a metal beam of claim 21 wherein the substantially fixed position recited in step (a) in which the metal beam is clamped includes compliance in the fixed position to allow the metal beam one degree of freedom.

* * * * *